US005831648A

United States Patent [19]

Mitani et al.

[11] Patent Number: 5,831,648

[45] Date of Patent: Nov. 3, 1998

[54] INK JET RECORDING HEAD

[75] Inventors: Masao Mitani; Kenji Yamada; Katsunori Kawasumi; Kazuo Shimizu; Osamu Machida, all of Hitachinaka, Japan

[73] Assignee: Hitachi Koki Co., Ltd., Tokyo, Japan

[21] Appl. No.: 580,273

[22] Filed: Dec. 27, 1995

Related U.S. Application Data

[63] Continuation-in-part of Ser. No. 68,348, May 28, 1993, abandoned.

[30] Foreign Application Priority Data

| | | | |
|---|---|---|---|
| May 29, 1992 | [JP] | Japan | 4-138498 |
| Jul. 3, 1992 | [JP] | Japan | 4-176731 |
| Mar. 26, 1993 | [JP] | Japan | 5-068257 |
| Mar. 3, 1995 | [JP] | Japan | 7-043968 |

[51] Int. Cl.[6] ..... B41J 2/05

[52] U.S. Cl. ..... 347/62; 347/56

[58] Field of Search ..... 347/56–58, 61–64

[56] References Cited

U.S. PATENT DOCUMENTS

| | | | |
|---|---|---|---|
| 4,517,444 | 5/1985 | Kawahito et al. . | |
| 4,532,530 | 7/1985 | Hawkins | 347/62 |
| 4,535,343 | 8/1985 | Wright et al. . | |
| 4,772,520 | 9/1988 | Takeno et al. . | |
| 4,951,063 | 8/1990 | Hawkins et al. | 347/62 |
| 5,142,308 | 8/1992 | Hasegawa et al. | 347/62 |
| 5,206,659 | 4/1993 | Sakurai et al. | 347/62 |

FOREIGN PATENT DOCUMENTS

| | | |
|---|---|---|
| 0 438 295 A1 | 7/1991 | European Pat. Off. . |
| 04466918 | 9/1991 | European Pat. Off. . |
| 0583474A1 | 2/1994 | European Pat. Off. . |
| 0 594 369 A2 | 4/1994 | European Pat. Off. . |
| 0594369A2 | 4/1994 | European Pat. Off. . |
| 2126182 | 12/1971 | Germany . |

(List continued on next page.)

OTHER PUBLICATIONS

German Office Action with English translation.

German Office Action dated Dec. 10, 1996 and translation thereof.

Collection of Presentations from the 27th Japan Thermal Transmission Symposium, 1990—5, pp. 334–336.

J.P. Baker et al.; "Design and Development of a Color Thermal Inkjet Print Cartridge"; Hewlett–Packard Journal, Aug. 1988.

Patent Abstracts of Japan, M–589, May 20, 1987, vol. 11, No. 15, 61–284450, "Liquid Jet Recording Head and Apparatus".

Patent Abstracts of Japan, M–885, Oct. 27, 1989, vol. 13, No. 477, 1–188347, "Liquid Jet Recording Head".

Patent Abstracts of Japan, M–218, May 28, 1983, vol. 7, No. 124, 58–42466, "Liquid Jet Recording Method".

Official Action of the German Patent Office, File No. P 43 17 944.4–27, of Hitachi–Koki Co., Ltd., dated Sep. 14, 1994, with English translation.

Keil et al.; "Electrische Kontakte und ihre Werkstoffe"; pp. 245–247, (1984).

J.S. Aden et al.; "The Third–Generation HP Thermal InkJet Printhead"; Hewlett–Packard Journal, Feb. 1994, pp. 41–45.

R.A. Askeland et al.; "The Second–Generation Thermal InkJet Structure"; Hewlett–Packard Journal, Aug. 1988, pp. 28–31.

*Primary Examiner*—Peter S. Wong
*Assistant Examiner*—Gregory J. Tcatley, Jr.
*Attorney, Agent, or Firm*—Whithman, Curtis & Whithman

[57] ABSTRACT

A plurality of heaters are provided on a silicon substrate in a plurality of individual ink channels. Each heater is constructed from a thin-film resistor and a thin-film conductor. The thin-film resistor is formed with an electrical insulation layer at its upper surface. The electrical insulation layer is formed through subjecting the thin-film resistor to a high-temperature thermal oxidation process. The thin-film resistor formed with the electrical insulation layer may be covered with an additional insulation layer of a thickness substantially equal to the thin-film resistor.

16 Claims, 21 Drawing Sheets

FOREIGN PATENT DOCUMENTS

| | | | |
|---|---|---|---|
| 3224081 | 6/1981 | Germany . | |
| 3717294 | 12/1987 | Germany . | |
| 4317944A1 | 12/1993 | Germany . | |
| 19505465A1 | 8/1995 | Germany . | |
| 48-9622 | 2/1973 | Japan . | |
| 53-11037 | 2/1978 | Japan . | |
| 53-110374 | 9/1978 | Japan . | |
| 54-39529 | 3/1979 | Japan . | |
| 54-51837 | 4/1979 | Japan . | |
| 54-59936 | 5/1979 | Japan . | |
| 57-61582 | 4/1982 | Japan . | |
| 58-84401 | 5/1983 | Japan . | |
| 61-49860 | 3/1986 | Japan | 347/62 |
| 62-167056 | 7/1987 | Japan | 347/62 |
| 62-240558 | 10/1987 | Japan . | |
| 07153603 | 6/1995 | Japan . | |
| WO 90/13428 | 11/1990 | WIPO | 29/890.1 |
| WO9013248 | 11/1990 | WIPO . | |
| WO9013428 | 11/1990 | WIPO . | |

INK JET RECORDING HEAD

CROSS-REFERENCE TO RELATED APPLICATION

This application is a continuation-in-part application of the U.S. application Ser. No. 08/068,348 filed May 28, 1993, abandoned.

BACKGROUND OF THE INVENTION

1. Field of the Invention

The present invention relates to a printhead for an image recording device and more particularly to a printhead for an image recording device which uses heat energy for ejecting drops of recording liquid such as ink from an orifice to project the liquid drops for recording an image on a recording medium.

2. Description of the Related Art

Japanese Patent Application Kokai Nos. SHO-48-9622 and 54-51837 have proposed a thermal-pulse-type ink jet image recorder. In a printhead for the ink jet image recorder of this type, a pulse of heat rapidly vaporizes a small amount of ink. The force produced by the expansion of the resultant vapor bubble ejects an ink drop from an orifice. The vapor bubble then collapses and disappears. Applying another thermal pulse repeats the ejection frequency. The printhead for the ink jet image recorder of this type is provided with a heater resistor for creating such a pulse heat. Japanese Patent Application Kokai No. 54-59936, a presentation made at the Feb. 26, 1992 convention for High Technology for Hard Copy sponsored by the Japan Technology Transfer Association, and the August 1988 edition of Hewlett-Packard-Journal have proposed a heater resistor of a type that has a thin-film resistor for being supplied with an electric pulse and generates a pulse heat. FIG. 1 shows the structure of the conventional heater resistor 200 which includes a thermal capacitor layer 211 formed on a substrate (not shown), a thin-film resistor 213 formed over the thermal capacitor layer 211, a thin-film conductor 214 formed partially over the surface of the thin-film resistor 213, an antioxidation layer 215 formed over both the thin-film resistor 213 and the thin-film conductor 214. An anti-cavitation layer 216 is further formed over the antioxidation layer 215. An additional anti-cavitation layer 217 may be formed on the anti-cavitation layer 216.

This complicated structure is required mainly because of deficiencies in conventional thin-film resistors 213, as follows: Many materials, such as TaAl and $HfB_2$, are conventionally known and commonly used as the thin-film resistor 213. These materials have sufficiently high resistivity, excellent heat resistance, and pulse resistance. It is known, however, that all of these materials are easily burned out when heated in an oxidation atmosphere. Accordingly, when these materials are heated while being immersed in the ink, they will be easily oxidized by air dissolved in the ink. In order to protect the thin-film resistor 213 from such a chemical attack, the antioxidation layer 215, made from, for example, $SiO_2$ or $Si_3N_4$, is formed in a layer of several microns thick over the thin-film resistor 213.

It is also known that a shock wave is created when a vapor bubble generated by the heater resistor 200 collapses. The shock wave will therefore pound the antioxidation layer 215 and cavitation erosion such as cracks will be formed in the antioxidation layer 215. Thus formed cracks will short out the thin-film resistor 213. The anti-cavitation layers 216 and 217 are therefore provided for protecting the antioxidation layer 215 from the severe hydraulic forces produced when the vapor bubble thus collapses. The anti-cavitation layer 216 is generally made of an approximately 0.4 micron thick thin-film layer of tantalum.

The above-described antioxidation layer 215 and the anti-cavitation layers 216 and 217 are, however, sources of the following problems: The thin-film resistor 213 must heat the ink through these protective layers 215–217. Because the protective layers have a high total heat capacity, as high as 50–100 times higher than that of the thin-film resistor 213 itself, they form a thermal buffer between the thin-film resistor 213 and the ink. The thermal buffer increases the energy and time required to heat the ink, and therefore the heater resistor 200 must be supplied with an electric pulse current having a long pulsewidth of about 5–10 $\mu$s. The thermal buffer also increases the time required to cool the thin-film resistor 213 after bubble formation, and therefore heat remaining at the surface of the heater resistor 200 will cause unwanted secondary nucleation to form weak bubbles that will obstruct stable ink ejection and prevent increase in the ejection frequency.

Thus, the complicated structure of the conventional heater resistor 200 is a limit to the ink ejection frequency of the thermal-pulse-type ink jet image recorder.

The printhead for the thermal-pulse-type ink jet image recorder includes a plurality of ink drop generators each having an ink channel which is communicated, at its one end, with a common ink reservoir and which is formed, at its other end, with an orifice for jetting out an ink drop. The above-described heater resistor 200 is located in the ink channel. In operation, the ink channel and the ink reservoir are filled with ink. The heater resistor 200 creates a pulse of heat, which vaporizes a small amount of ink positioned on the heater resistor to generate a vapor bubble. The force produced by the expansion of the resultant vapor bubble ejects an ink drop through the orifice. The vapor bubble then collapses and disappears. Within the orifice, after the ink drop is thus fired, the ink meniscus is retracted deeply because of the ink lost with the fired drop. The warped meniscus then recovers its equilibrium due to surface tension of the ink with respect to the walls of the ink channel, whereupon the drop generator is refilled with the ink. Then, the heater resistor again creates heat for subsequent ink ejection.

Before the drop generator is subsequently fired, therefore, the meniscus must be returned to its rest position to refill the pulse generator with ink. However, since the conventional drop generator thus refills by means of surface tension of the ink alone, a long time is required to refill the drop generator. This long waiting time is another limit to the ink ejection frequency of the thermal-pulse-type ink jet image recorder.

Japanese Patent Application Kokai No. SHO-62-240558 has noticed the above-described problem related to the meniscus, and has proposed a method for increasing the ejection frequency. However, this method has problems with cross talk forming between adjacent orifices.

SUMMARY OF THE INVENTION

The present invention is therefore achieved to eliminate the above-described drawbacks of the conventional thermal-pulse-type ink jet image recorder, and therefore an object of the present invention is to provide a printhead for a thermal-pulse-type ink jet image recorder which can repeat ink ejection operation with high frequency and therefore can attain a high speed printing operation, without producing any crosstalk between adjacent orifices.

According to one aspect, the present invention therefore provides a heater resistor for the printhead of the thermal-pulse-type ink jet image recorder which has such a simple structure that has no protective layer but includes only a thin-film resistor for creating a thermal pulse and a thin-film conductor for supplying an electric pulse to the thin-film resistor. In other words, the present invention provides a liquid droplet ejecting recording head for ejecting from an orifice a recording liquid filled in a chamber communicated with the orifice in the form of a droplet, to thereby attach the droplet to image recording medium and record an image thereon, said liquid droplet ejecting recording head comprising: a wall defining a chamber for being filled with recording liquid, said wall having a portion for defining an orifice communicated with the chamber; and a thin-film resistor provided on a surface of said wall facing the chamber so as to be located in the chamber, said thin-film resistor having one surface facing the chamber with which said thin-film resistor may be exposed to the recording liquid contained in the chamber, said thin-film resistor being energized with pulsed electric current for generating pulsed heat to directly heat the recording liquid, to thereby allow the recording liquid to be ejected outside through the orifice from the chamber in the form of a droplet and to be attached onto a surface of image recording medium positioned in confrontation with the orifice. The liquid droplet ejecting recording head preferably further comprises a thin-film conductor electrically connected to the thin-film resistor for applying the pulsed electric current thereto, said thin-film conductor being provided on said thin-film resistor so as to have a surface with which said thin-film conductor may be exposed to the recording liquid contained in the chamber, said thin-film conductor being made of nickel.

The present inventor finds out that oxidization-resistant material such as Cr—Si—SiO alloy and Ta—Si—SiO alloy has also cavitation-resistant and galvanic corrosion-resistant properties and therefore is especially suitable for the thin-film resistor which will be exposed to recording liquid such as aqueous ink. The present inventor further finds out that conductive material such as nickel has galvanic corrosion-resistant property and therefore is especially suitable for the thin-film conductor which will be also exposed to the recording liquid such as the aqueous ink.

According to the present invention, since the protective layers are thus eliminated from the heater resistor and the thin-film resistor can directly heat the recording liquid such as the ink, the heater resistor can control the temperature of the ink within a short period of time. The protective layer-less heater resistor of the present invention therefore can attain a high ink ejection frequency.

According to another aspect, the present inventor notices the manner how a vapor bubble generated by the heater resistor expands and collapses varies dependently on the structure of the ink channel defining a space surrounding the vapor bubble. The present inventor then finds out that in an ink channel having an asymmetric space, a vapor bubble creates an ink pumping action for unidirectionally pushing ink. More specifically, the vapor bubble causes ink to flow from a larger space toward a smaller space in the ink channel. The present invention therefore provides an improved structure of an ink channel for dynamically creating an ink flow from the ink reservoir toward the orifice to thereby increase the ink ejection frequency.

In other words, the present invention provides a liquid droplet ejecting recording head for ejecting from an orifice a recording liquid filled in a chamber communicated with the orifice in the form of a droplet, to thereby attach the droplet to image recording medium and record an image thereon, said liquid droplet ejecting recording head comprising: a wall defining a reservoir for storing therein recording liquid and a channel for being filled with the recording liquid supplied from the reservoir, the channel having an upstream end and a downstream end, the channel being communicated with the reservoir at the upstream end thereof, the wall further defining an orifice communicated with the downstream end of the channel, the channel having a channel axis along which the channel extends from the upstream end toward the downstream end, the wall further defining a cross-sectional area of the channel along a plane perpendicular to the channel axis, the channel having a cross-sectional area distributing part in which the cross-sectional area of the channel is decreased along the channel axis in a direction toward the downstream end; and a heater resistor provided in the channel at the cross-sectional area distributing part, said heater resistor being energized with pulsed electric current for generating pulsed heat to heat the recording liquid contained in the channel, to thereby allow the recording liquid to be ejected outside through the orifice from the chamber in the form of a droplet and to be attached onto a surface of image recording medium positioned in confrontation with the orifice and allow the recording liquid to flow along the channel axis in a direction from the upstream end toward the downstream end.

According to a further aspect, the present invention provides another method of increasing the ink ejection frequency of the thermal-pulse-type ink jet image recorder. In this method, the printhead is provided with not only a heater resistor (ejection heater resistor) used for ejecting an ink drop through the orifice but also a heater resistor (supply heater resistor) used for supplying ink from the reservoir to the ink channel to thereby quickly refill the ink channel after when an ink drop is ejected through the orifice. The supply heater resistor is preferably positioned in the above-described asymmetric space formed in the ink channel.

In other words, the present invention provides a liquid droplet ejecting recording head for ejecting from an orifice a recording liquid filled in a chamber communicated with the orifice in the form of a droplet, to thereby attach the droplet to image recording medium and record an image thereon, the liquid droplet ejecting recording head comprising: a wall defining a reservoir for storing therein recording liquid and a channel for being filled with the recording liquid supplied from the reservoir, the channel having an upstream end and a downstream end, the channel being communicated with the reservoir at the upstream end thereof, the wall further defining an orifice communicated with the downstream end of the channel, the channel having a channel axis along which the recording liquid may flow in a flowing direction from the upstream end toward the downstream end; an ejection heater resistor provided in the channel at a position adjacent to the downstream end, said ejection heater resistor being energized with pulsed electric current for generating pulsed heat to heat the recording liquid located thereon, to thereby allow the recording liquid to be ejected outside through the orifice from the chamber in the form of a droplet and to be attached onto a surface of image recording medium positioned in confrontation with the orifice; and a supply heater resistor provided in the channel at an upstream side of said ejection heater resistor in the flowing direction, said supply heater resistor being energized with pulsed electric current for generating pulsed heat to heat the recording liquid located thereon, to thereby allow the recording liquid to flow along the channel axis in the flowing direction.

According to still another aspect, the present invention provides an ink ejection print head for ejecting ink droplets to print an image, the print head comprising: a silicon substrate; a partition wall provided on the silicon substrate for defining a plurality of individual ink channels; a plurality of heaters provided in the individual ink channels, each heater being made from a thin-film resistor and a thin-film conductor formed on the silicon substrate, a surface of each thin-film resistor having an electrically-insulation layer formed by high-temperature thermal oxidation of the thin-film resistor; and an ejection nozzle portion formed with a plurality of nozzles at positions in correspondence with the plurality of heaters.

According to another aspect, the present invention provides an ink ejection printer for printing an image with ejected ink, the printer comprising: a print head including a silicon substrate, a partition wall provided on the silicon substrate for defining a plurality of individual ink channels, a plurality of heaters provided in the individual ink channels, each heater being made from a thin-film resistor and a thin-film conductor formed on the silicon substrate, a surface of each thin-film resistor having an electrically-insulation layer formed by high-temperature thermal oxidation of the thin-film resistor, and an ejection nozzle portion formed with a plurality of nozzles at positions in correspondence with the plurality of heaters; support means for supporting an image recording medium at a position confronting the plurality of nozzles of the print head; and motion means for attaining a relative motion between the print head and the support means in a direction orthogonal to a direction along which the plurality of nozzles are aligned.

According to a further aspect, the present invention provides a method of fabricating an ink ejection head, the method comprising the steps of: providing a plurality of heaters to one surface of a silicon substrate, each heater including a thin-film resistor and a thin-film conductor; subjecting each thin-film resistor to a thermal oxidation process, thereby forming an electrically-insulation layer on an exposed surface of the thin-film resistors; forming a partition wall on the surface of the silicon substrate, the partition wall being formed with a plurality of ink channels in correspondence with the plurality of heaters; and forming an orifice plate on the surface of the silicon substrate, the orifice plate being formed with a plurality of nozzles.

During the thermal oxidation process, the plurality of thin-film resistors may be pulsingly energized in an oxidizing atmosphere. The thermal oxidation process may include the steps of: monitoring the resistance values of the respective thin-film resistors while the thin-film resistors are pulsingly energized; and adjusting the pulsingly energization applied to the respective thin-film resistors based on the monitored results, thereby controlling the resistance values of all the thin-film resistors to be substantially uniform.

BRIEF DESCRIPTION OF THE DRAWINGS

The above and other objects, features and advantages of the invention will become more apparent from reading the following description of the preferred embodiments taken in connection with the accompanying drawings in which:

FIGS. 17A through 17D schematically show expansion and collapse of thermally produced bubbles in differing environments, each of which has an upper sketch for showing a top view of the bubble and a lower sketch for showing a side view of the bubble, wherein FIG. 17A shows the manner how the bubble expands where no obstruction is provided for the expansion, FIG. 17B shows the manner how the bubble expands where a ceiling is provided for obstructing the expansion, FIG. 17C shows the manner how the bubble expands and collapses to vanish where a ceiling and two lateral side walls are provided for obstructing the expansion, and FIG. 17D shows the manner how the bubble expands and collapses to vanish in an asymmetric shaped space:

FIG. 32(*b*) is a sectional view of the ink jet print head of the fourth embodiment taken along a line XXXI-IB–XXXIIB' of FIG. 32(*a*);

FIG. 33(*b*) illustrates observation results showing how bubbles and ink droplets move in the nozzle of the comparative example;

In the drawings, the same or like parts or components are referred to by the same or like reference numerals.

DETAILED DESCRIPTION OF THE PREFERRED EMBODIMENTS

A printhead according to preferred embodiments of the present invention will be described below while referring to the accompanying drawings.

A first embodiment of the present invention will be described below with reference to FIGS. 2A–2D through 16A–16B.

The first embodiment provides a protective-layerless heater resistor 100 for a printhead of the thermal-pulse-type ink jet image recorder.

Figure 2A:
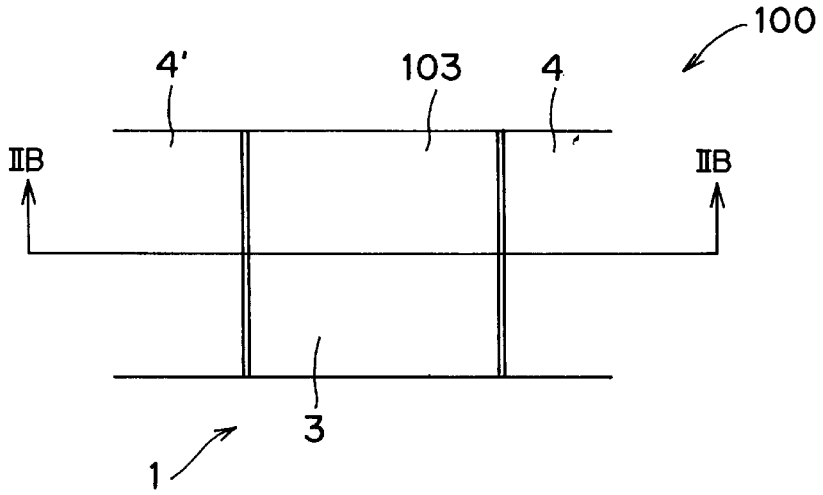
FIG. 2A shows a top view of a heater resistor according to a first preferred embodiment of the present invention.
Figure 2B:
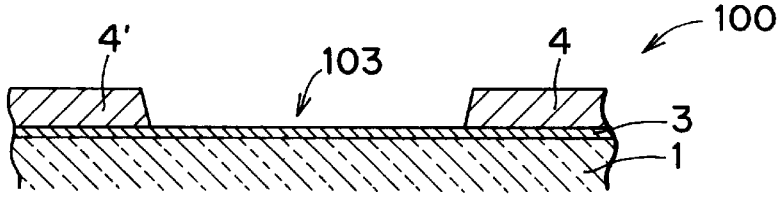
FIG. 2B shows a sectional side view of the heater resistor of FIG. 2A taken along a line IIB—IIB.

As shown in FIGS. 2A and 2B, the heater resistor 100 includes: a thin-film resistor 3 of a rectangular shape made of Cr—Si—SiO alloy; and a pair of conductors (electrodes) 4 and 4' each of a rectangular thin-film shape which are formed over the thin-film resistor 3 with such a gap being formed therebetween that the thin-film resistor 3 may be exposed at its area 103 of approximately a square shape. With such a structure, the electrodes 4 and 4' are connected through the square shaped area 103 of the thin-film resistor 3. The electrodes 4 and 4' are connected to an electric power source (not shown) to form a series circuit. With such a structure, the power source supplies the square-shaped area 103 of the thin-film resistor 3 with pulsed electric current via the electrodes 4 and 4' to allow the square-shaped area 103 to create a pulsed heat. The square-shaped area 103 will be referred to as a "heating area", hereinafter.

The present inventor produced the heater resistor 100 in the following manner: An approximately 700 Å thick Cr—Si—SiO alloy resistor thin-film layer was first formed over the glass substrate 1 made of borosilicate glass Pyrex, trademark). Then, an approximately 2000 Å thick Ni thin-film layer was deposited over the Cr—Si—SiO alloy resistor thin-film layer. Then, a photoetching operation is conducted for etching the Ni layer into the electrodes 4 and 4' so that the Cr—Si—SiO alloy resistor thin-film layer may be exposed at its square-shaped area 103 having an area of about 40×40 $\mu$m. Another photoetching operation is further performed for etching the Cr—Si—SiO alloy resistor thin-film layer into a rectangular film shape 3, with the use of etching solution of nitric acid and hydrofluoric acid mixture.

Figure 3:
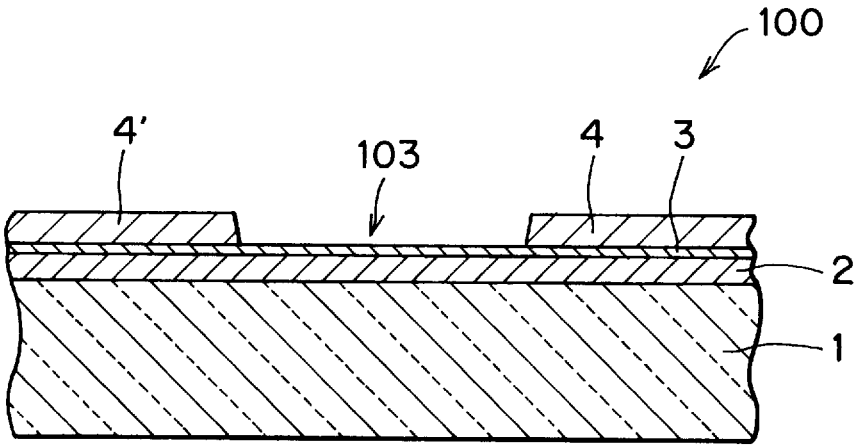
FIG. 3 shows a sectional side view of a modification of the heater resistor shown in FIGS. 2A and 2B.

It is noted that to protect the glass substrate 1 from the etching solution of nitric acid and hydrofluoric acid mixture during the etching operation for the thin-film resistor 3, an approximately 1,500 Å thick $Ta_2O_5$ thermal oxidation layer 2 may be formed to the glass substrate 1 before etching, as shown in FIG. 3.

When the heater resistor 100 with the above-described structure is provided in the printhead, the heater resistor 100 is formed on the glass substrate 1 which serves as a bottom wall of an ink channel of each drop generator. When the ink channel is filled with ink, therefore, the heating area 103 of the thin-film resistor 3 and the electrodes 4 and 4' will be exposed to ink. The electrode 4 serves as an individual electrode operated for selectively applying the pulsed electric current to the corresponding thin-film resistor 3 to thereby selectively allow the heating area 103 of the resistor to create pulsed heat. On the other hand, the other electrode 4' serves as a common electrode for the heater resistors of all the drop generators provided in the printhead.

Figure 4:
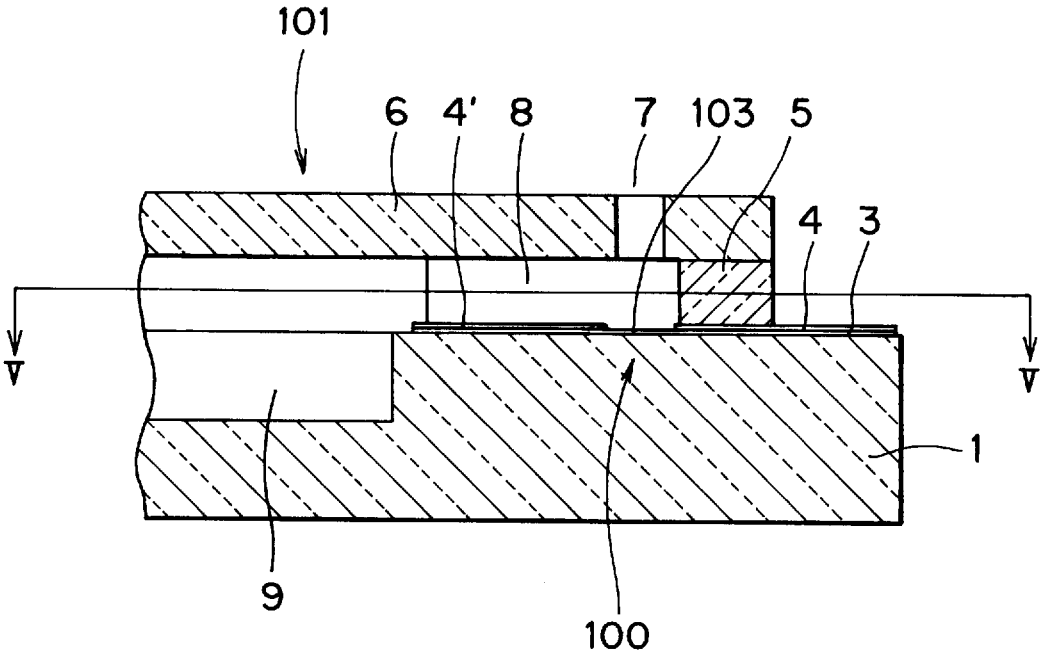
FIG. 4 shows a schematic sectional side view of a perpendicular-type printhead provided with the heater resistor shown in FIGS. 2A and 2B.
Figure 5:
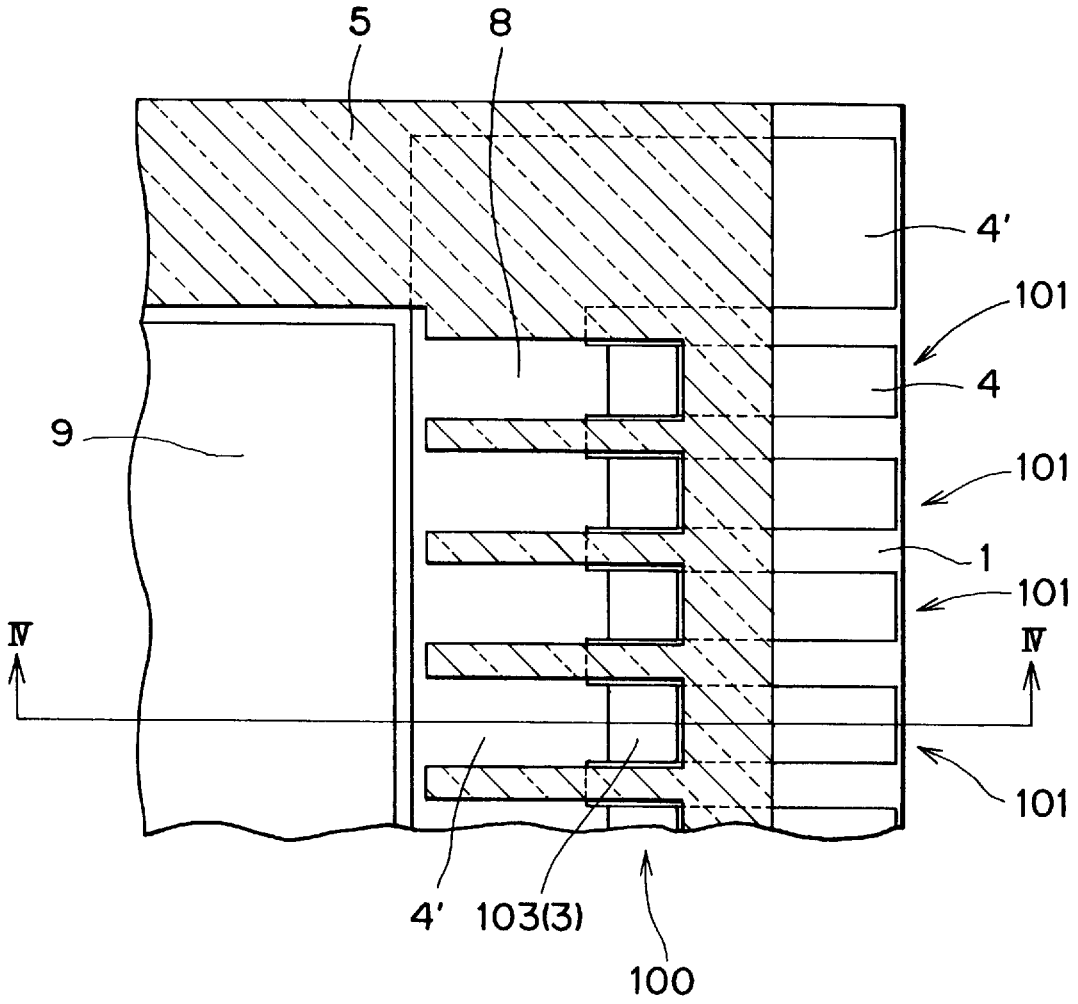
FIG. 5 shows a schematic cross-sectional view of the perpendicular-type printhead shown in FIG. 4 taken along a line V—V.

One example of a printhead provided with the above-described heater resistor 100 of the present invention will be described below while referring to FIGS. 4 and 5. The printhead is formed with a common ink reservoir or tank 9 and a plurality of drop generators 101 aligned as shown in FIG. 5. Each drop generator 101 includes an ink channel 8 which is communicated, at its one end, with the ink reservoir 9 and which has, at its other end, an orifice 7 for ejecting an ink drop. The printhead of this example is of a type in which the orifice 7 extends perpendicularly to the ink channel 8 (which will be referred to as a "perpendicular-type", hereinafter.) As shown in FIG. 4, the heater resistor 100 is provided on a glass substrate 1 at such a position that constructs a bottom wall of the ink channel 8 of each drop generator 101. The heater resistor 100 is located in the ink channel 8 at such a position that the heating area 103 of the thin-film resistor 3 may confront the orifice 7. The orifice 7 therefore extends perpendicularly to the surface of the heating area 103. The common electrodes 4' provided in the respective drop generators 101 are connected to one another to form a common electrode, as shown in FIG. 5.

In operation, the ink channel 8 is filled with ink supplied from the ink reservoir 9 so that the orifice 7 is also filled with ink. When an electric pulse is applied to the thin-film resistor 3, the heating area 103 heats in a thermal pulse. A small amount of ink positioned on the heating area 103 is vaporized by the thermal pulse into a vapor bubble. The vapor bubble expands, and the force of the expanding vapor bubble in a direction perpendicular to the surface of the heating area 103 ejects ink through the orifice toward image recording medium (not shown) located before the orifice.

Now, the reasons why the present invention utilizes the Cr—Si—SiO alloy thin-film resistor 3 and the Ni thin-film conductors 4 and 4' for constructing the protective layer-less heater resistor 100 of the present invention will be described in detail.

The excellent antioxidation properties of the Cr—Si—SiO alloy thin-film resistor has been announced at the 1982 Electronics Components Conference held in San Diego and described in Japanese Patent Application Kokai No. SHO-58-84401. The present inventor has noted these properties of the Cr—Si—SiO alloy thin-film resistor and has speculated that the Cr—Si—SiO alloy thin-film resistor should present good antigalvanic corrosion and anti-cavitation properties when operated while immersed in water-based ink and therefore should be suitable for a protection layer-less heater resistor for the thermal-pulse-type ink jet image recorder.

In order to develop the protection layer-less heater resistor, therefore, the remaining issues for the present inventor have been to develop a thin-film conductor which can present sufficient antigalvanic corrosion and anti-cavitation properties when operated while immersed in water-based ink and therefore which can be combined with the Cr—Si—SiO alloy for forming the protection layer-less heater resistor.

Figure 6:
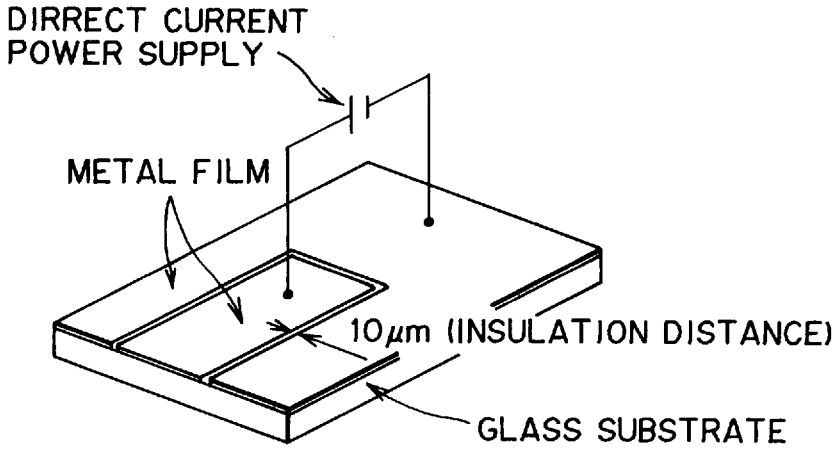
FIG. 6 shows a perspective view of a test plate used in evaluating anti-galvanic corrosion properties of thin-film conductor materials.

To develop such a conductor, the present inventor performed the following series of experiments to compare susceptibility to galvanic corrosion of several conductive materials such as nickel, tantalum, tungsten, molybdenum, aluminum, and chromium. That is, a test plate as shown in FIG. 6 was first produced for each metal by forming a corresponding metal thin film of approximately 1,000 Å thick on a glass plate. The metal thin-film was formed with a groove for defining two sections and for effecting an approximately 10 $\mu$m insulation distance therebetween. To investigate the relation between applied voltage and amount of galvanic corrosion for each metal, each test plate was separately immersed in water, and various values of DC voltage were applied between the two sections of each metal plate through the insulation distance groove. Each of the various values of DC voltage was applied for one minute. Since both water and commonly used water-based inks have a neutral pH of 7.0, the results of these tests would be the same if performed in water-based ink.

Figure 7:
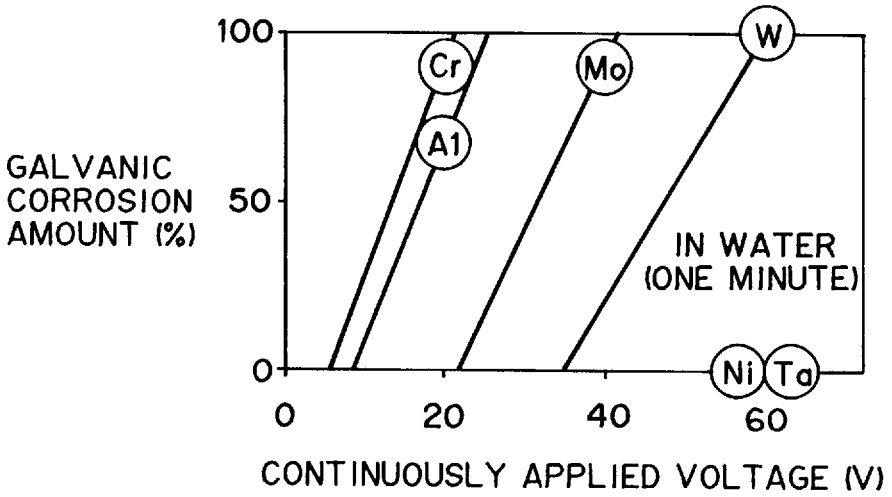
FIG. 7 shows a graphical representation of anti-galvanic corrosion properties of various metal films.

The test results of FIG. 7 show that nickel and tantalum presented the greatest resistance to galvanic corrosion. Next came tungsten, molybdenum, aluminum, and chromium in that order. It is noted that tantalum may not be deposited on a Cr—Si—SiO alloy thin-film resistor through wet etching operation, but nickel can be. Furthermore, mounting nickel is technologically easy. Accordingly, nickel is preferable to tantalum as the thin-film conductor for the heater resistor. Nickel is thus determined as the most suitable material as the thin-film conductor for the heater resistor.

Figure 8:
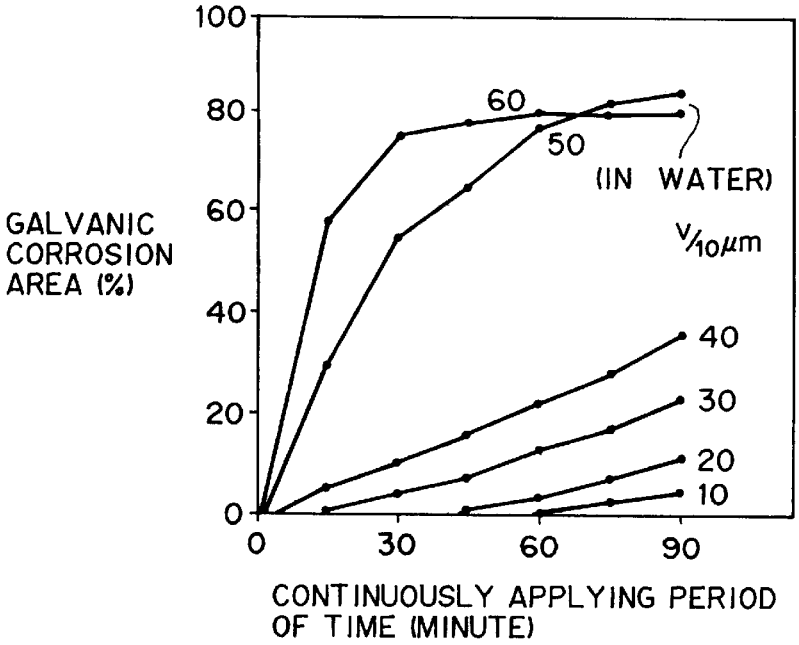
FIG. 8 shows a graphical representation of anti-galvanic corrosion properties of a Ni thin film conductor.

The present inventor then performed tests to confirm the galvanic corrosion resistent property of a nickel thin-film conductor. The present inventor immersed the test plate of nickel shown in FIG. 6 in water and applied various amounts of voltages to the test plate. The test result of FIG. 8 shows that the Ni thin-film conductor presented almost no galvanic corrosion even after continuous application of 20 V/10 $\mu$m voltage for 20 to 30 minutes.

The present inventor then produced the printhead shown in FIGS. 4 and 5 with the use of the above-described produced heater resistor 100 shown in FIG. 2. Then, the present inventor tested the image recording ability of the printhead. As will be described later, the printhead provided clear image recording using the principle of drop on demand, when an electric pulse having pulsewidth of 1 $\mu$s and having power of 0.5 to 1 W/dot was applied to the heater resistor 100. In other words, the optimum pulse drive conditions for the heater resistor 100 was determined to apply the electric pulse of pulsewidth of 1 $\mu$s and of power of 0.5 to 1 W/dot to the heater resistor. Since the resistance value of the Cr—Si—SiO alloy thin-film resistor 3 was approximately 2,000 Ω, the voltage that must be applied between the Ni thin-film conductors 4 and 4' at each pulse can be calculated as 32 to 45 volts. Since the length of the heating area 103 of the Cr—Si—SiO alloy thin-film resistor 3 defining the distance between the conductors 4 and 4' was approximately 40 $\mu$m, the pulse voltage that must be applied between the Ni thin-film conductors per 10 $\mu$m can be calculated as 8 to 12 V/10 $\mu$m. When one billion pulses are applied to the heater resistor 100, the total time duration when the electric voltage is applied between the conductors 4 and 4' is calculated as 17 minutes (1 $\mu$s×1 billion pulses=17 minutes). Taking the above into consideration, the test result of FIG. 8 shows that the Ni thin-film conductor can withstand galvanic corrosion up to almost three times higher at applied voltage (i.e., almost ten times higher at applied energy) than required under the optimum thermal pulse conditions.

Figure 9:
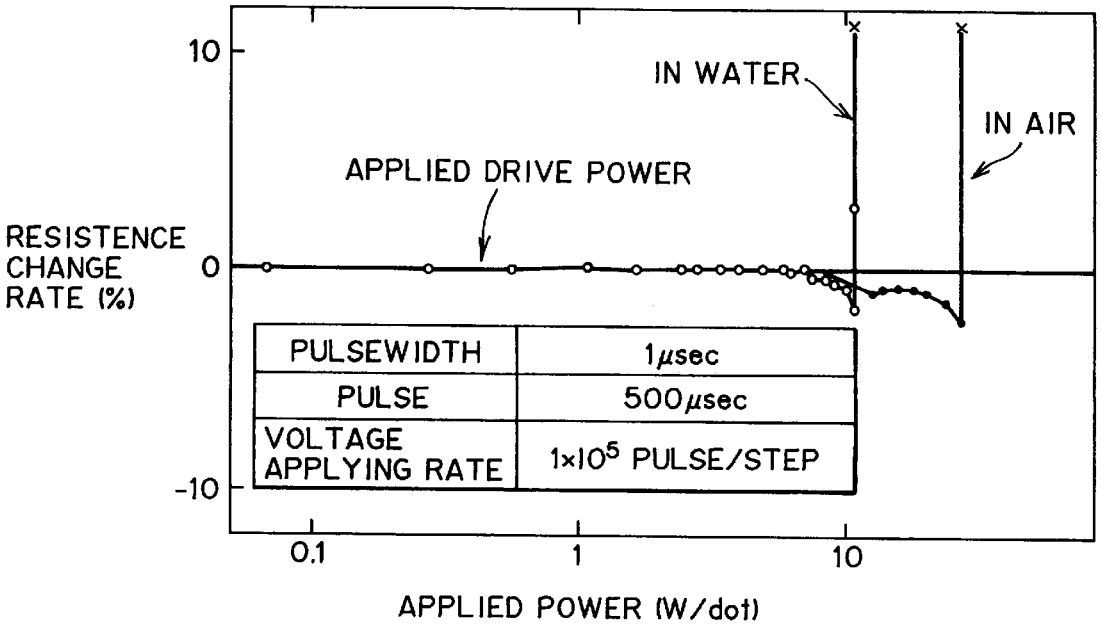
FIG. 9 shows a graphical representation of results of step-up stress tests for evaluating the heater resistor shown in FIGS. 2A and 2B.

The present inventor then produced two heater resistors 100 each of which had the Cr—Si—SiO alloy thin-film resistor 3 and the approximately 2,000 Å thick Ni thin-film conductors 4 and 4'. The present inventor subjected the two heater resistors 100 to two sets of step-up stress tests (SST). More specifically, the present inventor immersed one heater resistor 100 in water and energized the heater resistor at increasing power until it failed. Similarly, the present inventor placed the other heater resistor 100 in air and energized the heater resistor at increasing power until it blew down. The test results of FIG. 9 showed that the heater resistor 100 blew under much lower energies when in water than when in air (i.e. a ratio of 1:2.5). This shows that in water, the heater resistor 100 breaks down mainly due to cavitation. It is noted, however, that cavitation breaks down the heater resistor at about 10 W/dot, which is 10 to 20 times larger than the above-described actual drive power of 0.5 to 1 W/dot according to the drive pulse condition. This clearly shows that, as predicted, the heater resistor 100 constructed by the Cr—Si—SiO alloy thin-film resistor 3 and the Ni thin-film conductors 4, 4' has sufficient anti-cavitation properties.

The present inventor immersed the heater resistor 100 in water and supplied it with, one billion times, electric pulses of pulsewidth of 1 $\mu$s and of a large power of 2W/dot. No change could be observed in the resistance value of the heater resistor. The heater resistor 100 therefore could be expected to have a sufficiently long life. In other words, the heater resistor 100 constructed by the Cr—Si—Si alloy thin-film resistor 3 and the Ni thin-film conductors 4, 4' has, as predicted, sufficient antigalvanic corrosion properties to attain a long life.

Figure 1:
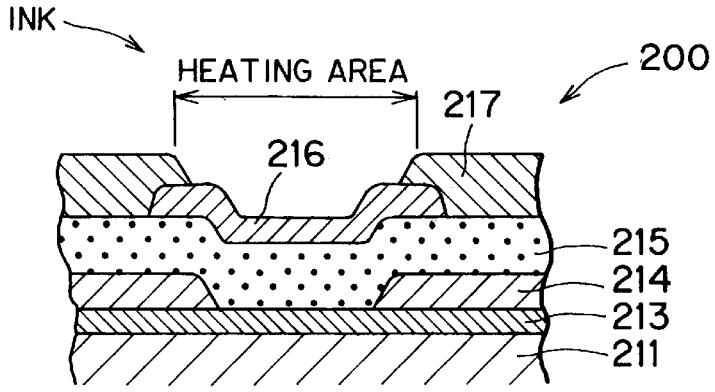
FIG. 1 shows a sectional side view of a conventional heater resistor.

As mentioned already, the present inventor evaluated the image recording performance of the printhead shown in FIGS. 4 and 5 provided with the heater resistor 100. As comparative examples, the present inventor examined the image recording performances of two types of conventional printheads A and B both of which are provided with the conventional heater resistors 200. More specifically, the printhead A was provided with such a conventional heater resistor 200 as has the three protective layers 215, 216 and 217 shown in FIG. 1. The printhead B was provided with such a conventional heater resistor 200 as has the two protective layers 215 and 216. The printhead B was of the perpendicular-type in which the orifice extends perpendicularly to the ink channel. The printhead A was of a type in which the orifice and the ink channel are axially aligned (which will be referred to as a "parallel-type", hereinafter). As apparent from the experimental results shown in Table 1 below, the printhead of the present invention showed image recording performance vastly superior to those of the two conventional printheads A and B.

TABLE 1

| | Printhead According to the Present Invention | Conventional Printhead A | Conventional Printhead B |
|---|---|---|---|
| Ejected ink volume (pl) | 100 | 100 | 100 |
| Applied Energy (μJ/drop) | 0.5 | 30 | 17 |
| Applied Power (W/pulse) | 0.5 | 3 | 3.4 |
| Applied Pulse Width (μs) | 1 | 10 | 5 |
| Ejection Speed (m/s) | 12 | 6 | 12 |
| Ejection Frequencies (kHz) | 5 | 4 | 3 |

As apparent from the Table 1, the protection-layerless heater resistor 100 of the present invention attains ejection frequency of 25% to 60% higher than the conventional heater resistors 200, for the following reasons: In the heater resistor 100 of the present invention, the thermal buffer created by the protection layers is eliminated. With such a structure, only an extremely short thermal pulse of 1 μs suffices for vaporizing the ink. Furthermore, the meniscus of ink more quickly recovers its equilibrium because the surface of the heater resistor 100 can cool to a sufficiently low temperature by the time the bubble collapses and therefore unwanted secondary nucleation is avoided.

Hereinafter will be given an explanation of the mechanism how the protective layer-less heater resistor 100 of the present invention can thus quickly recover the retracted meniscus to its equilibrium, relative to the conventional heater resistor 200 with protective layers:

In the conventional printhead that uses the heater resistor 200 with protective layers, generally, about 30 μs after an electric pulse is applied to the heater resistor, the ink ejection is completed and the meniscus is maximally retracted. However, up to 10 times this period, or 200 to 300 μs, is required for the meniscus to recover its equilibrium shape. This is because, the meniscus recovers its equilibrium by means of surface tension alone. More specifically, the temperature at the surface of the thick protective layers of the conventional heater resistor 200 rises several μs's after the heater resistor 213 produces a thermal pulse. After the bubble is generated, the temperature at the surface of the protective layers continues rising for another few μs's. This is because the bubble thermally insulates the surface of the protective layers so that heat may not escape into the ink in the ink channel. After completion of the thermal pulse, the heater resistor then cools by heat removal to the substrate. However, by evaluating the time constant of the thermal capacitor layer 211 and the protective layers 215–217, 30 μs after the prior bubble nucleation, that is, when the bubble collapses, the surface temperature of the uppermost protective layer can be determined to have still about 100° to 200° C. This high temperature reheats the ink, causing unwanted secondary nucleation of weak bubbles. The weak bubbles slow recovery of the meniscus.

Contrarily, the protective-layerless heater resistor 100 of the present invention can be operated with a short drive pulse of 1 μs and can provide efficient transfer of heat to the ink, compared with the conventional heater resistors with the thick protective layers. Accordingly, the heater resistor 100 does not need the thermal capacitor layer 211. Even where the thermal capacitor layer is provided between the thin-film resistor 3 and the substrate 1, it can be made much less thinner, for example, 1 to 2 μm when the thermal capacitor layer is made of $SiO_2$. Accordingly, when the bubble collapses, the heater resistor 100 of the present invention is sufficiently cooled to near ambient temperature. No weak bubbles are therefore formed and the meniscus can quickly recover its equilibrium shape. Accordingly, the drop generator can be subsequently fired, and ejection frequency can be increased.

The experimental results of Table 1 further show that the heater resistor 100 of the present invention requires 1/30th to 1/60th less energy than the conventional heater resistors 200 to vaporize ink into a vapor bubble. In other words, eliminating the protection layers, which make the conventional heater resistors 50 to 100 times thicker than the thin-film resistor provided therein, reduces energy requirements at about 1/30th to 1/60th per drop. This shows that 98% to 99% of the energy used in the conventional heater resistor is not for bubble generation, but is lost, for example, in heating the substrate and the ink. Ink is therefore easily scorched by this additional heat, necessitating strict temperature control in conventional printheads.

Figure 10:
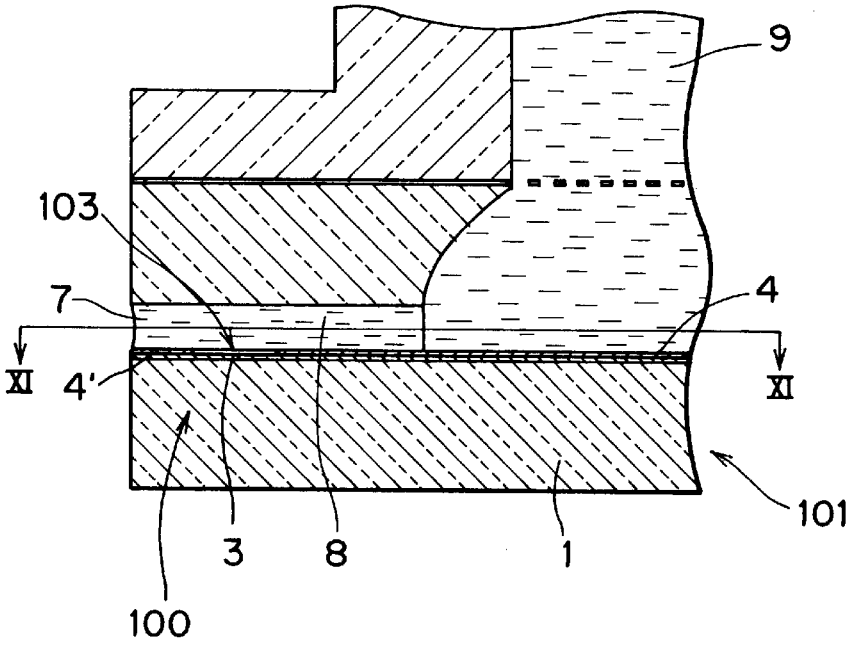
FIG. 10 shows a schematic sectional side view of a parallel-type printhead provided with the heater resistor shown in FIGS. 2A and 2B.

Another example of a printhead provided with the protection layer-less heater resistor 100 of the present invention will be described below while referring to FIGS. 10 and 11. The printhead in this example is of a parallel-type as shown in FIG. 10 in which the orifice 7 and the ink channel 8 are axially aligned. Reference numerals used for this example refer to the same components and parts as those in the example described with referring to FIGS. 4 and 5.

Figure 11:
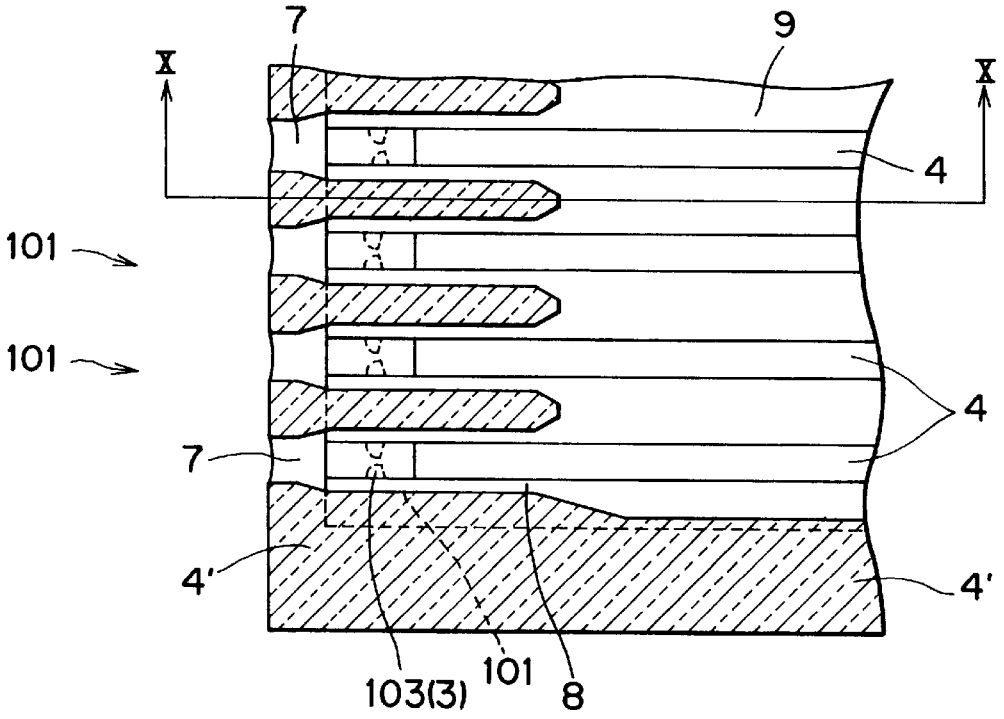
FIG. 11 shows a cross-sectional view of the printhead shown in FIG. 10 taken along a line XI—XI.

The printhead of this example also has a plurality of drop generators 101 aligned as shown in FIG. 11 and a common ink reservoir 9 connected to each drop generator 101. Each drop generator 101 has an ink channel 8 which is communicated, at its one end, to the common ink reservoir 9 and has, at the other end, an orifice 7 for ejecting a drop ink. The orifice 7 extends from the one end of the ink channel 8 in a direction parallel to the ink channel 8 so that the orifice 7 is axially aligned with the ink channel 8. The heater resistor 100 of the present invention is provided to a substrate 1 defining a bottom wall of the ink channel 8 at such a position that the heating area 103 may be located adjacent to the orifice 7. With such a structure, the orifice 7 extends in a direction parallel to the surface of the heating area 103.

In operation, the ink channel 8 is filled with ink supplied from the ink reservoir 9 so that the orifice 7 may be filled with ink. When an electric pulse is applied to the heater resistor 100, the heating area 103 heats in a thermal pulse to vaporize a small amount of ink placed on the heating area 103 into a vapor bubble. The force of expanding vapor bubble in a direction parallel to the surface of the heating area 103 ejects ink through the orifice 7 toward image recording medium (not shown) positioned before the orifice 7.

The present inventor produced the printhead of this example. The ink channel 8 of each drop generator 100 had a cross-sectional area of 50 μm×30 μm and a length of about 400 μm. The heater resistor 100 shown in FIG. 2 was provided in the drop generator 101 to the bottom wall 1 of the ink channel 8. The distance between the heating area 103 and the orifice 7 was about 100 μm. In other words, the distance between the heating area 103 and the ink reservoir 9 was about 300 μm. The heating area 103 had a width of 10 μm and a length of 50 μm. That is, the heating area 103 is of a rectangular shape having an area of 30 μm×50 μm. The thin-film resistor 3 forming the heating area 103 had a thickness of about 700 Å and a resistance of about 2 KΩ.

The present inventor tested the image recording ability of the printhead. The inventor filled both the ink reservoir 9 and the ink channels 8 of the printhead with ink, and applied, via the electrode 4 and the common electrode 4', a voltage pulse with pulsewidth of 10 μs and voltage of 10 V to the heater resistor 100 at frequency of 5 KHz. Image recording medium (not shown) was fed step by step at a position 1.2 mm away from the orifice 7. The printhead provided clear image recording using the principle of drop on demand.

In this printing operation, the thermal energy applied to the heater resistor 100 per dot can be expressed equationally as follows:

$$50\ \text{mW}\times 10\ \mu\text{S}=0.5\ \mu\text{J}.$$

This equation shows that the protective layer-less heater resistor 100 according to the present invention requires only 1/30th to 1/60th the energy required by the conventional heater resistors 200 for printing images of equal or superior quality, as described already. Since only 1/30th to 1/60th the energy is needed to operate the heater resistor 100 according to the present invention compared with those used in conventional printheads, not even consecutive operation will raise temperatures in the printhead to significant levels. This simplifies temperature regulation in the printhead of the present invention and allows stable ink ejection.

The inventor then changed the pulsewidth (10 μs) and the power (50 mW) of the voltage pulse applied to the heater resistor 100 without changing the thermal energy applied thereto per dot (0.5 μJ), and tested how the image printing ability of the printhead was changed. More specifically, the inventor changed the pulsewidth of the voltage pulse into 50 μs and the power thereof into 10 mW. (In this printing operation, the thermal energy applied per dot to the heater resistor 100 can therefore be expressed equationally as follows:

$$10\ \text{mW}\times 50\ \mu\text{S}=0.5\ \mu\text{J}).$$

Almost no difference in the recorded images could be observed. This test result therefore shows that required power of the electric pulse can be reduced by widening the pulsewidth thereof, without lowering the ink ejection performance. By broadening the pulsewidth, even the maximum power required to simultaneously fire orifices of all the drop generators can be suppressed to a low level.

The inventor then evaluated the life of the printhead of this example during consecutive operation. The heater resistor 100 operated for over three billion dots (pulses). This result shows that the heater resistor 100 of the present invention has a long life compared with the conventional heater resistors 200, and therefore shows that the heater resistor 100 of the present invention has excellent anti-oxidization and anti-cavitation qualities relative to the conventional heater resistors 200.

It should be noted that perpendicular-type printheads can more effectively use the expansion power of expanding bubbles for ejecting ink than parallel-type printheads. This is because bubbles expand more rapidly in the direction perpendicular to the surface of the heater resistor than in the direction parallel to the surface of the heater resistor. Accordingly, the printhead of this example attains the drop velocity of about 7 m/s that is about ½ of that of the printhead of the perpendicular-type shown in FIGS. 4 and 5.

Figure 12:
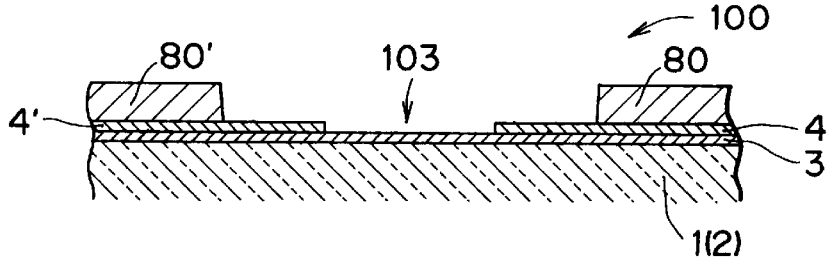
FIG. 12 shows a sectional side view of another modification of the heater resistor shown in FIGS. 2A and 2B.

According to the present invention, the heater resistor 100 of the present invention shown in FIGS. 2 and 3 can be modified into that as shown in FIG. 12. In the heater resistor 100 of this example, the thickness of the conductors 4 and 4' is made small relative to that shown in FIGS. 2 and 3, and is, for example, only about 1,000 Å. An electrode 80 and a common electrode 80' to be electrically connected to the power supply (not shown) are additionally formed over the conductors 4 and 4', at positions distant from the heating area 103. In other words, the electrodes 80 and 80' are located where the effects of cavitation are insignificant, that is, far from where the shock wave caused by the collapsing bubble has the greatest impact. The electrodes 80 and 80' can therefore be made of material with poor anti-cavitation properties, such as aluminum.

The present inventor produced a printhead equipped with the heater resistor 100 of FIG. 12, and tested image recording performance of the printhead. The printhead achieved the same advantages as those achieved by the printhead equipped with the heater resistor 100 of FIG. 2.

Figure 13:
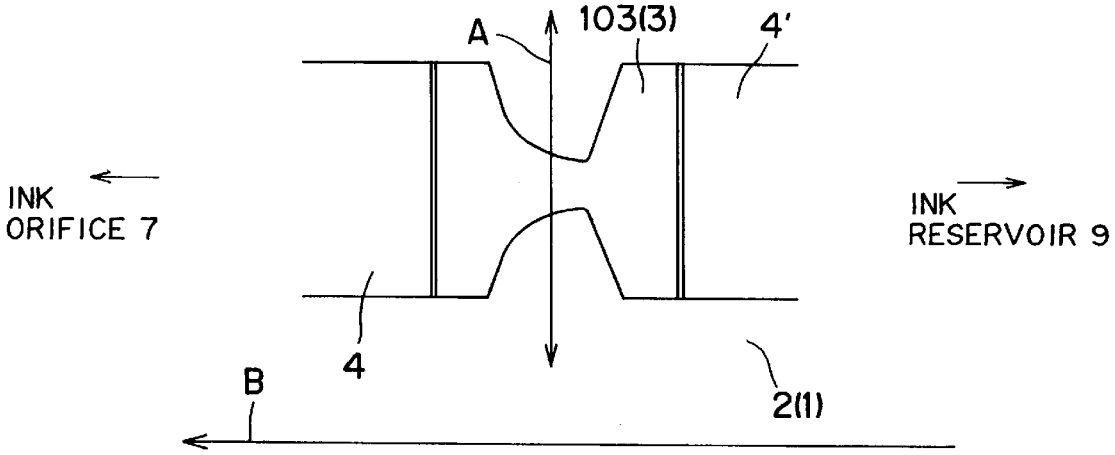
FIG. 13 shows a top view of a further modification of the heater resistor of FIGS. 2A and 2B which has an asymmetric shaped heating area.
Figure 14:
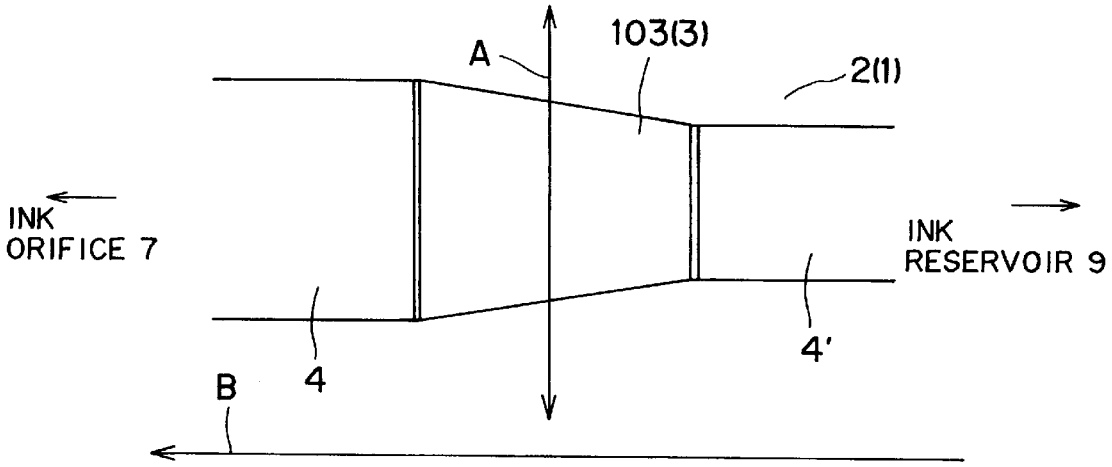
FIG. 14 shows a top view of another modification of the heater resistor of FIGS. 2A and 2B which has another asymmetric shaped heating area.

Though in the above description, the heating area 103 has a symmetric (square or rectangular) shape as shown in FIGS. 2A, 5 and 11, it can be shaped into an asymmetric shape in a direction in which the ink channel 8 extends. For example, the heating area 103 may be shaped as shown in FIGS. 13 and 14. (It should be noted that the asymmetric shaped applicable to the heating area 103 is not limited to the shape as shown in FIGS. 13 and 14, but may have various asymmetric shape). More specifically, the heating area 103 may have an axis A with respect to which the heating area 103 has an asymmetric shape. The heater resistor 100 having such an axis A should be provided in the ink channel in such a state that the axis A of the heating area 103 may extend perpendicularly to the direction B in which the ink channel 8 extends and therefore in which ink flow is attained from the ink reservoir to the orifice. Such an asymmetrically-shaped heating area 103 may be employed by the printhead of the parallel-type as shown in FIGS. 10 and 11.

The heater resistor 100 with the asymmetrically-shaped heating area 103 provides the following advantages:

When the heater resistor 100 is energized, the heating area 103 of the asymmetric shape creates an asymmetric thermal distribution on the surf ace of the resistor. Consequently, a vapor bubble will nucleate and expand asymmetrically. In other words, a vapor bubble will expand more rapidly toward the orifice 7 than toward the ink reservoir 9. The resultant pressure applied to the ink becomes also asymmetric, being stronger at the orifice side of the bubble than at the ink reservoir side. The decrease in backflow toward the ink reservoir 9 therefore translates to an increase in the refilling speed to the drop generator. The rapid refill of ink to the vicinity of the orifice for subsequent ejections allows an increased ejection frequency.

It is noted that Japanese Patent Application Kokai No. 54-39529 has proposed a thin-film resistor with a trapezoidal shape. However, a thick protective layer is provided over the thin-film resistor. Though the thin-film resistor creates trapezoidal thermal distribution, the protective layer uniformly transfers the heat to the ink, thereby diminishing potential benefits of having a thin-film resistor 100 with a trapezoidal shape. However, the heater resistor of the present invention is provided with no protection layer, and therefore the thin-film resister 3 is exposed to the ink, at the heating area 103, to directly heat the ink. Accordingly, the application of the asymmetric shape to the heating area 103 of the heater resistor 100 can effectively attain the above-described excellent advantages.

The inventor produced a printhead of parallel-type provided with the heater resistor 100 having the heating area 103 as shown in FIG. 13. FIG. 11 shows by a dotted line the state how the heater resistor 100 was mounted in the printhead. The inventor performed an experiment to determine the ink ejection speed of the printhead under the same conditions as those in the experiment conducted for the printhead of parallel-type of FIGS. 10 and 11 provided with the heater resistor 100 of FIG. 2 and described already. The experimental result shows that energy required to the heater resistor could be further reduced by about 30% and that ejection frequency could also be further increased by 1.2 to 1.3 times.

This high ejection frequency not only allows image recording speed faster than those of conventional thermal-pulse-type ink jet image recorders, but also reduces production costs and energy requirements.

Figure 15:
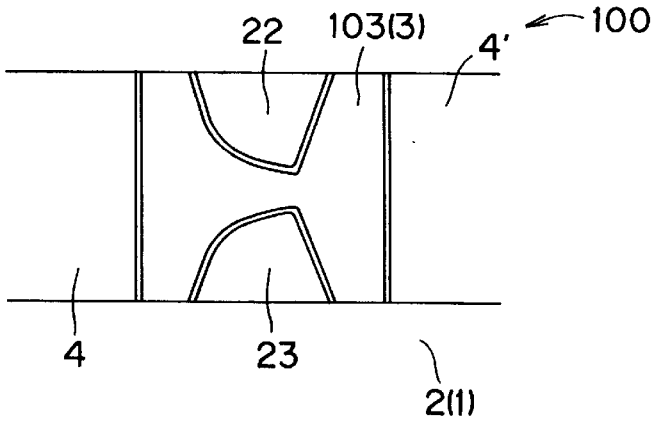
FIG. 15 shows a top view of the asymmetric shaped heater resistor shown in FIG. 13 modified by adding anti-corrosion films.

As described already, the substrate of the heater resistor 100 on which the thin-film resistor 3 is formed is a Pyrex (trademark) glass substrate 1 alone (FIG. 2) or with a $Ta_2O_5$ thermal oxidization film formed thereon (FIG. 3.) Although these substrate materials have good anti-cavitation properties, adding anti-cavitation protection films 22 and 23 over the substrate as shown in FIG. 15 adds further insurance against damage to the substrate by cavitation. The anti-cavitation protection provided by the protection films 22 and 23 also allows using other material, those with low resistance to cavitation, as substrate materials 1 for forming the heater resistor 100.

Material for forming the anti-cavitation protective films 22 and 23 should be the same as that of the thin-film resistor 3. That is, the films 22 and 23 should be formed of Cr—Si—SiO alloy. Thus, only through modifying the photomask to meet this design, the anti-cavitation protective films 22 and 23 can be easily produced at the same time when the thin-film resistor 3 is produced through the photoetching process. Accordingly, it is unnecessary to increase the number of manufacture steps. The gap or space formed between the heating area 103 and the anti-cavitation protective films 22 and 23 should be as narrow as possible. Conventional photoetching techniques can easily produce a gap or space of 1 to 2 $\mu$m. The present inventor produced the heater resistor 100 provided with the protective films 22 and 23 and tested the life of the heater resistor. It was found that the life of the heater resistor was further increased by 40 to 50%. This test result shows that although the portion of the substrate 1 (or 2) exposed by the narrow space between the heating area 103 and the films 22 and 23 is susceptible to cavitation, protection provided by the surrounding hard Cr—Si—SiO alloy layers of the heating area 103 and the protection layers 22 and 23 increases the life of the substrate by 40% to 50%. It is noted that although this method is described in regards to the heating area 103 shaped as shown in FIG. 13, this method can also be used for the heating area 103 shaped as shown in FIG. 14.

Figure 16A:
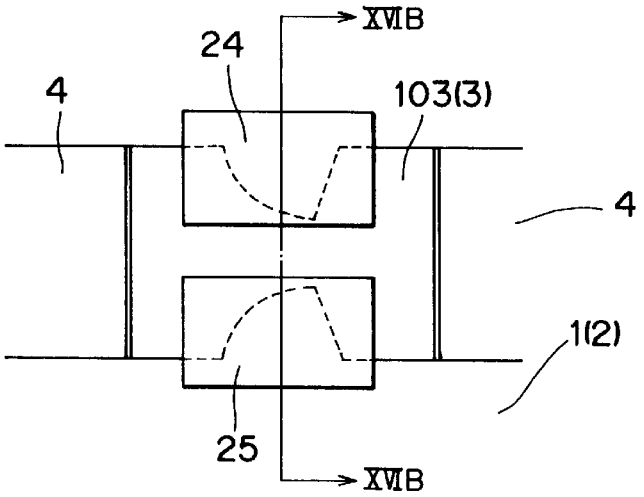
FIG. 16A shows a top view of the asymmetric shaped heater resistor shown in FIG. 13 modified by adding polyimide-type organic thin films.
Figure 16B:
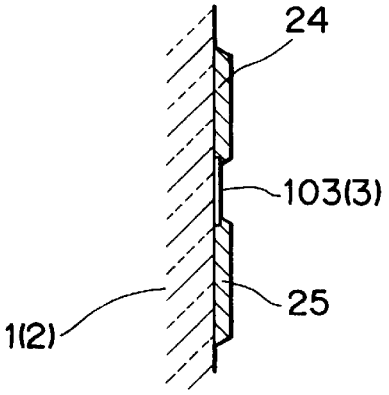
FIG. 16B shows a cross-sectional side view of the heater resister of FIG. 16A taken along a line XIV B—XIV B.

As shown in FIGS. 16*a* and 16*b*, forming polyimide-type organic thin-film layers 24 and 25 of several $\mu$m thick on the substrate 1 (or 2) to cover the edges of the heating area 103 will provide more direct protection against cavitation. The organic thin-films are heat resistant, and softly absorb shock energy, thereby preventing cavitation. Although this method increases the number of manufacture steps over the number required for producing the heater resistor shown in FIG. 13, the life of the substrate can be expected to further increase. Although this method is described in regards to the heating area 103 shaped as shown in FIG. 13, this method can also be used for the heating area 103 shaped as shown in FIG. 14.

A second embodiment of the present invention will be described below with reference to FIGS. 17A–17D, 18 and 19.

The present embodiment provides another method of increasing the ink ejection frequency. More specifically, the present embodiment develops the structure of the ink channel which enables to increase the ink ejection frequency.

Figure 17A:
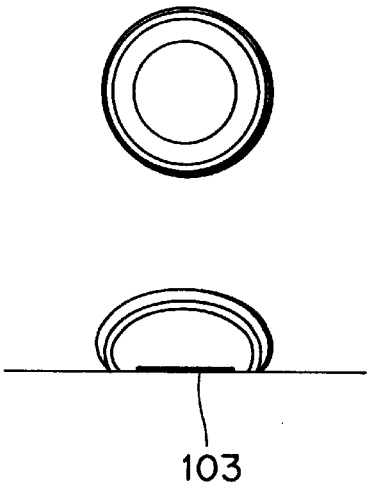
Figure 17B:
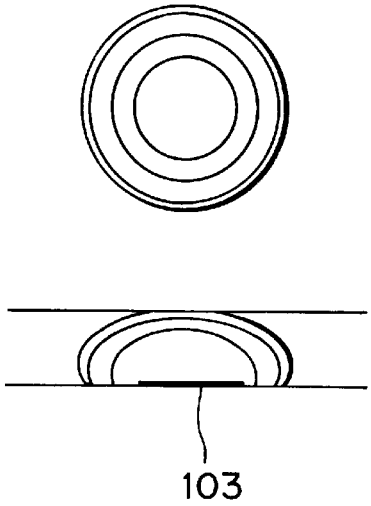
Figure 17C:
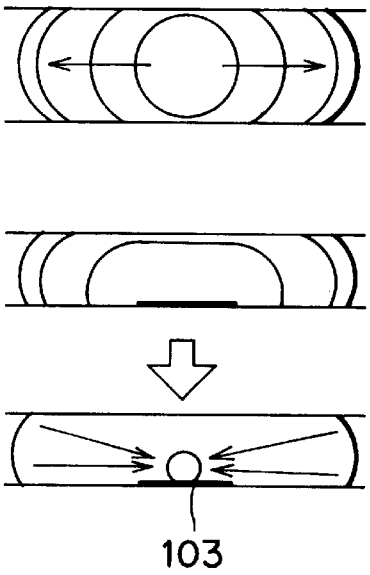

The present inventor observed that the manner in which vapor bubble generated by the heater resistor 100 expands and collapses varies dependently on the structure of the ink channel. The manner how a vapor bubble expands and collapses in the ink channel will be explained hereinafter while referring to FIG. 17. For simplicity, now assume that the heating area 103 of the heater resistor 100 has a circular shape. A bubble generated on the circular heating area 103 expands symmetrically when unobstructed as shown in FIG. 17A, obstructed by a symmetric ceiling (obstruction in the direction opposing the heater resistor 100) as shown in FIG. 17B, and obstructed by the symmetric ceiling and two symmetric lateral walls as shown in FIG. 17C. When expansion of a bubble is obstructed by the symmetric ceiling and the two symmetric lateral walls, the bubble vanishes at the same point as it nucleates as shown in FIG. 17C. The drop generator in conventional printheads has an ink channel defined by the symmetric ceiling and two symmetric lateral walls, similarly as shown in FIG. 17C. In the ink channel with such a symmetric structure, the flow of ink occurred when the bubble expands and the backflow of ink occurred when the bubble collapses center symmetrically on the heater resistor.

Figure 17D:
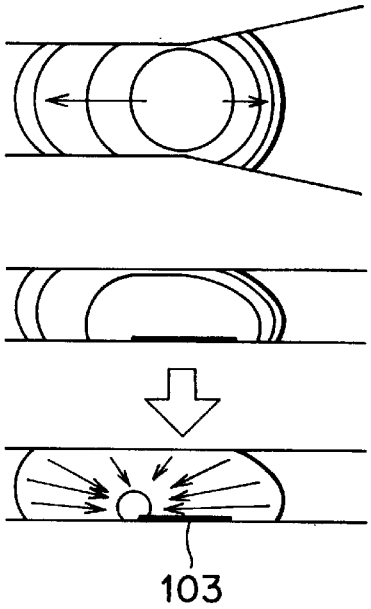

Contrarily, when a bubble is generated in an asymmetric space, its expansion becomes anisotropic as shown in FIG. 17D. That is, the bubble expands more quickly in the direction toward the smaller space than that toward the larger space. Consequently, the ink pushing force produced by the expanding surface of the bubble becomes greater toward the smaller space than toward the larger space. Accordingly, the expanding bubble causes ink to flow in a direction from the larger space toward the smaller space. When the thus expanded bubble collapses, its collapse becomes also anisotropic. In other words, the ink suction force produced by the collapsing surface of the bubble becomes greater at the larger space side than at the smaller space side. Thus, the collapsing bubble further causes the ink to flow from the larger space toward the smaller space. As apparent from the above explanation, in the asymmetrically-shaped ink channel, an anisotropic ink pumping force is generated by the expansion and collapse of the bubble to create ink flow from the larger space toward the smaller space. As a result, the bubble collapses at a position which is distant from the point where the bubble nucleates in the direction toward the smaller space as shown in FIG. 17D.

Figure 18:
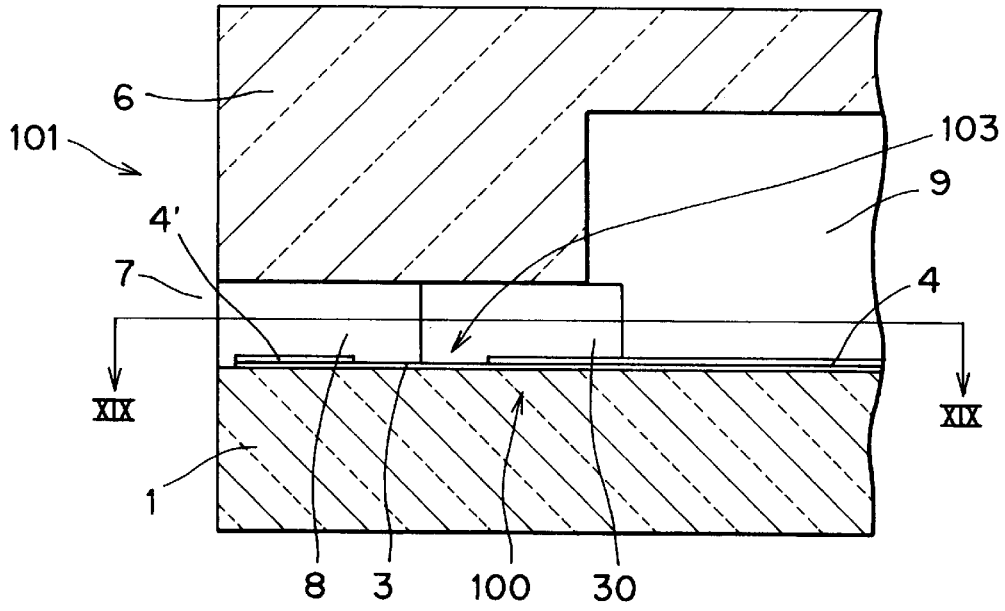
FIG. 18 shows a sectional side view of a parallel-type printhead according to a second preferred embodiment of the present invention.
Figure 19:
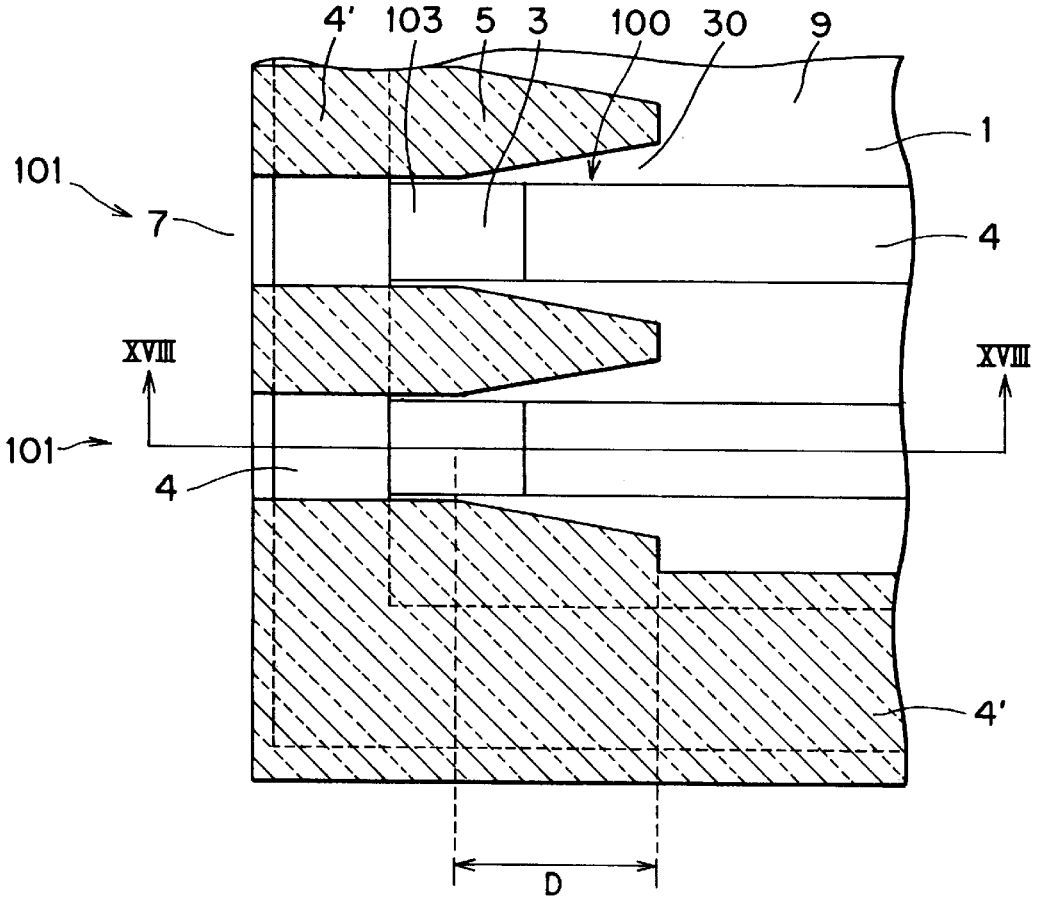
FIG. 19 shows a cross-sectional view of the printhead shown in FIG. 18 taken along a line XIX—XIX.

FIGS. 18 and 19 show a printhead of parallel-type to which applied is the asymmetric ink channel of the present embodiment. In other words, the ink channel 8 of this printhead has an asymmetric space portion 30 where the heating area 103 of the heater resistor 100 is located. In this example, since the ink channel 8 has a short length, the heating area 103 of the heater resistor 100 located adjacent to the orifice 7 is positioned also near to the end of the ink channel where the ink channel is communicated with the ink reservoir 9. Accordingly, the asymmetric space portion 30 is formed in the ink channel at the one end thereof where the ink channel is communicated with the ink reservoir. In the asymmetric space portion 30, the ink channel 8 is broader at the ink reservoir side than at the orifice side. The pumping action created by the asymmetric space portion 30 therefore unidirectionally pushes the ink toward the orifice 7. In this example, as shown in FIG. 19, the asymmetric space portion 30 is formed by slanted surfaces of the lateral walls or barriers 5 separating the corresponding ink channel 8 from neighboring ink channels. It should be noted that the asymmetric space portion 30 can also be formed by obliquely raising the ceiling 6, or forming a trench in the substrate 1, at the portion where the heating area 103 is located, to achieve the same effects. Combining these methods can also produce an efficient ink pumping action.

The ink channel 8 formed with the asymmetric space portion 30 of the present embodiment can eject ink at a frequency greatly increased (two to three times) over conventional printheads. An increase in ejection frequency can be achieved whether the ink channel 8 is provided with a conventional heater resistor 200 with protective layers or the protective-layerless heater resistor 100 of the first embodiment of the present invention. In other words, although the protective-layerless heater resistor 100 is provided in the ink channel 8 in FIGS. 18 and 19, even if the heater resistor 100 is replaced with the conventional heater resistor 200, the great advantage of the asymmetric space portion 30 can be attained. It is noted, however, that using the protection-layerless heater resistor 100 of the first embodiment can increase thermal efficiency by 50 times and can increase ejection frequency further by 20% to 30%, as described in the first embodiment. The printhead of this embodiment provided with the asymmetric space portion 30 and the protective layer-less heater resistor 100 can stably operate at an ejection frequency up to about 15 kHz.

In the present embodiment, the lateral wall or barrier 5 between drop generators 101 must be sufficiently thick to make the asymmetric space portion 30 by slanting the surface of the wall 5. The thick wall, however, slightly reduces the dot density of the printhead. For high density image recording, two or more rows of orifices must be provided, with orifices of different rows having staggered positioning.

Using the asymmetric shaped heating area 103 depicted in FIGS. 13 and 14, backflow of ink toward the ink reservoir side can be further decreased, as described above. The further decrease in backflow toward the ink reservoir may restrain a crosstalk which will possibly occur when backflow of ink toward the reservoir pushes ink in a neighboring drop generator toward its nozzle so as to erroneously allow an ink drop to be ejected outside. Thus, combining the asymmetrically-shaped heating area 103 with the asymmetrically-shaped space portion 30 can further decrease the distance or margin D between the heating area 103 and the ink reservoir 9, without increasing crosstalk.

It should be no ted that the above-described asymmetric space portion 30 can also be formed in the ink channel 8 of the printhead of perpendicular-type at a position where the heating area 103 is located.

A third embodiment will be described below with reference to FIGS. 20A–20D and 21 through 30. The third embodiment provides a further method for increasing the ink ejection frequency.

The most important condition necessary to stably eject ink from the orifice is that the meniscus to the ink be stable. The present inventor therefore notices the manner how the meniscus retracted by a prior ejection recovers equilibrium. As described already, conventional printheads rely on the surface tension of the ink to return the meniscus to equilibrium. Accordingly, before subsequent ejection of ink, the meniscus must naturally return to its rest position.

Figure 20A:
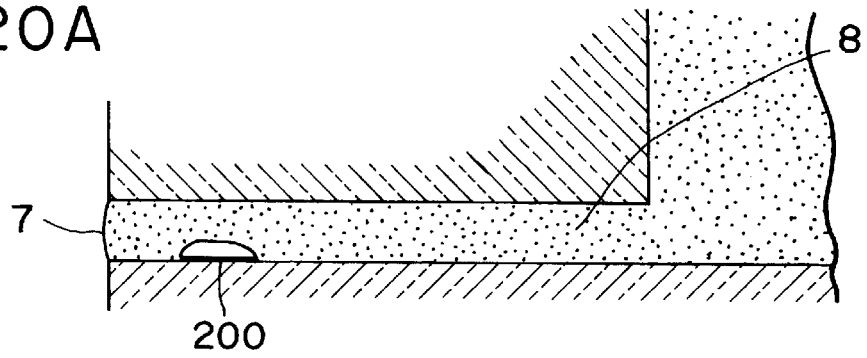
FIGS. 20A through 20D schematically show the manner how a bubble expands and collapses and ink drop ejects in a drop generator.
Figure 20B:
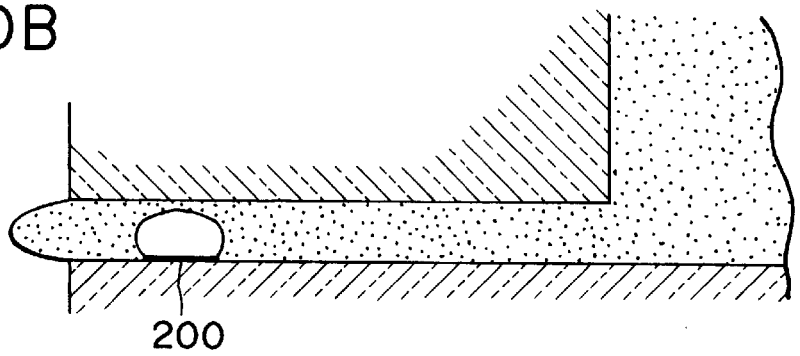
Figure 20C:
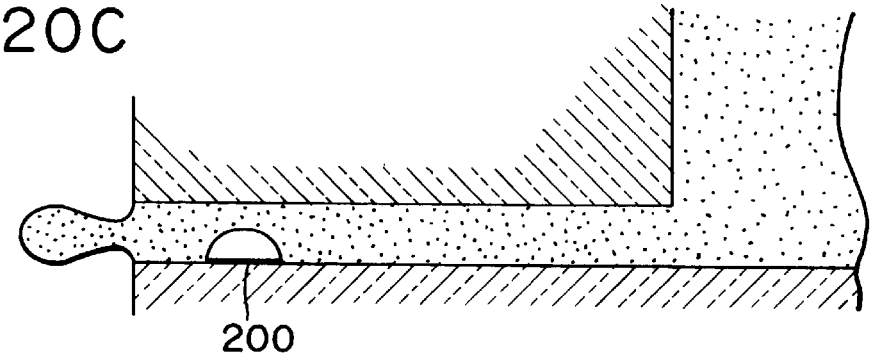
Figure 20D:
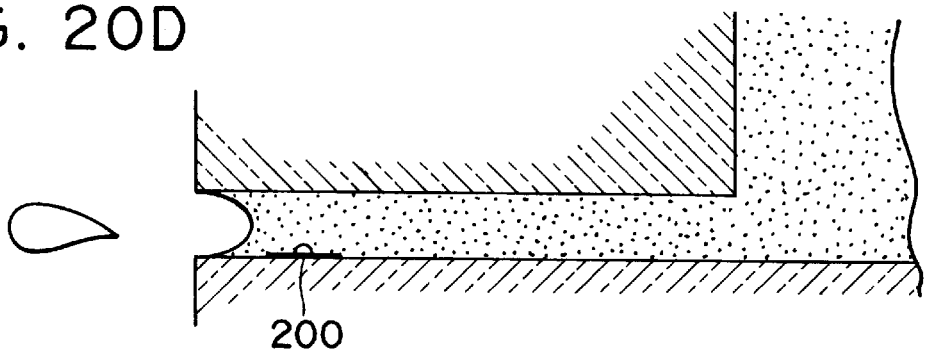

In the conventional printhead, after when the heater resistor is supplied with an electric pulse as shown in FIG. 20A, some period of time is required until the generated vapor bubble finally ejects the drop ink from the orifice 7 and the meniscus is maximally retracted as shown in FIG. 20D. (For example, if the conventional heater resistor 200 with the protective layers is used, time period of about 30 $\mu$s is required from the step 20A until the step 20D, as described already). However, several times or more of this period is required for recovering the thus retracted meniscus to equilibrium and refill the orifice with ink again. In other words, time period required from the step 20D till the step 20A is several times or more the time period required from the step 20A till the step 20D. (For example, if the conventional heater resistor 200 is used, 200 to 300 $\mu$s is required from the step 20D till the step 20 A, as described already). This is because, as mentioned above, the drop generator refills by means of surface tension alone. Therefore, the time required for refilling the drop generator determines the ejection frequency.

Figure 21:
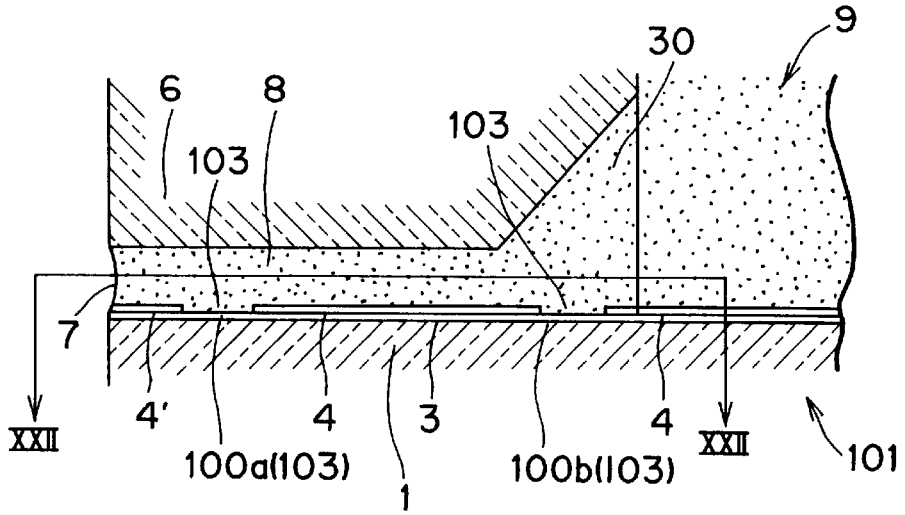
FIG. 21 shows a sectional side view of a parallel-type printhead according to an example of a third preferred embodiment of the present invention.
Figure 22:
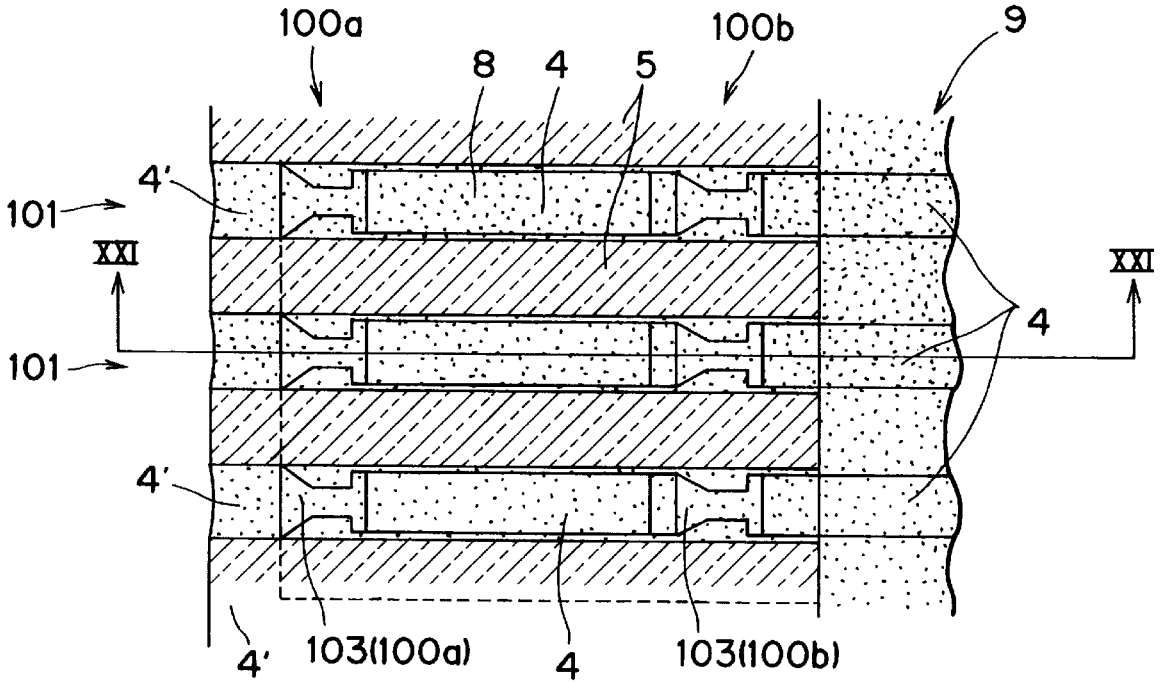
FIG. 22 shows a cross-sectional view of the printhead shown in FIG. 21 taken along a line XXII—XXII.
Figure 23A:
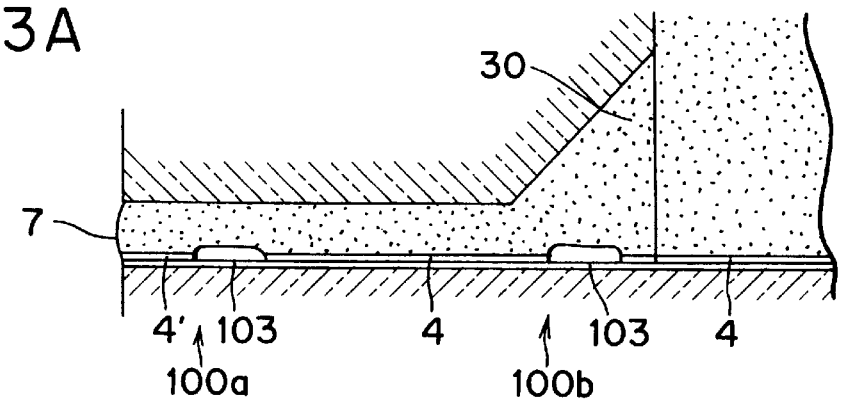
FIGS. 23A through 23D schematically show the manner how bubbles expand and collapse and an ink drop is ejected in the printhead shown in FIGS. 21 and 22.
Figure 23B:
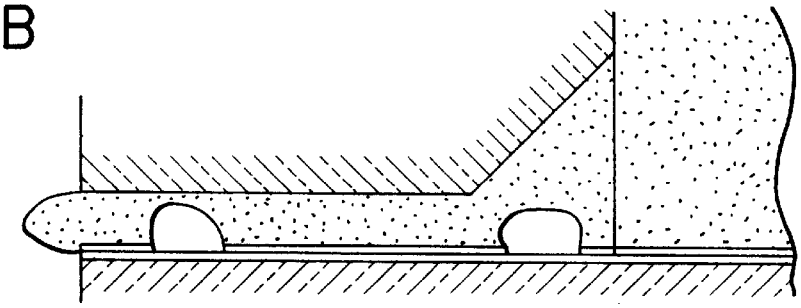
Figure 23C:
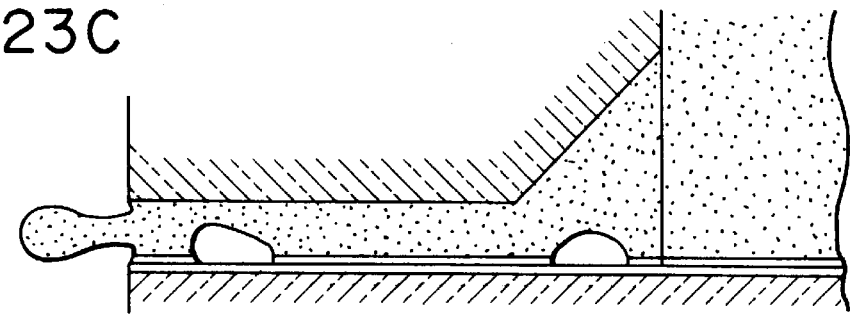
Figure 23D:
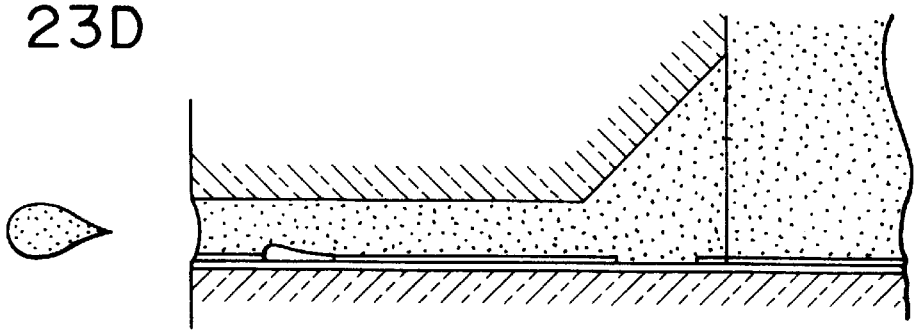

In order to increase the ejection frequency, the present embodiment provides a method for enhancing the recovering action of the meniscus. This method uses the pumping action depicted in the second preferred embodiment to dynamicly return the meniscus to its rest position so that the drop generator can be subsequently fired. In other words, the ink channel is shaped to broaden near the ink reservoir 9 to form the asymmetric space portion 30. According to this method, furthermore, two heater resistors are provided to the ink channel 8 of each drop generator 101: one near the orifice 7, as in the first and second embodiments, and an additional near the ink reservoir 9, as shown in FIGS. 21 and 22. The additional heater resistor is located in the asymmetric space portion 30 as formed near to the ink reservoir 9.

The heater resistor 100*a* positioned near the orifice 7 (which will be referred to as an "ejection heater resistor," hereinafter) is for ejecting ink from the orifice 7 in the same way as described in the first and second embodiments. The heater resistor 100*b* provided near the ink reservoir 9 (which will be referred to as a "supply heater resistor," hereinafter) additionally provided in the present embodiment is for supplying ink to refill the ink channel 8, i.e., the orifice 7, after an ink ejection. More specifically, the expanding force of a vapor bubble generated on the heater resistor 100*b* pushes ink in the direction toward the orifice. Accordingly, the amount of ink lost by a prior ejection is quickly refilled.

The mechanism how the above-described structure of the present embodiment increases the ink ejection frequency will be described in detail, hereinafter:

The supply heater resistor 100*b* is located in the asymmetric space portion 30 formed in the ink channel 8 near the ink reservoir 9. Accordingly, as described in the second embodiment, the bubble generated by the supply heater resistor 100*b* and expanding in the asymmetric space portion 30 produces an anisotropic expansion force. The anisotropic expansion force forcibly pushes ink toward the orifice 7. When the bubble collapses in the asymmetric space portion 30, the collapsing bubble also produces an anisotropic suction force which causes the ink to further flow from the ink reservoir 9 toward the orifice 7, so that the drop generator can be quickly refilled.

Because the supply heater resistor 100*b*, although in the asymmetric space portion 30, is in the corresponding ink channel 8, the expansion of the bubble achieved on the supply heater resistor 100*b* applies almost no pressure to neighboring ink channels 8. Therefore, the meniscus in all drop generators, even those adjacent to active drop generators, can achieve equilibrium so that subsequent ejections can be certainly achieved. Consequently, the ejection frequency can be increased over that of conventional printheads.

It is noted that the number of the supply heater resistor 100*b* provided in the asymmetric space portion 30 is not limited to one. A plurality of supply heater resistors 100*b* may be provided in the asymmetric space portion 30.

There are no particular restrictions regarding the shape of each of the ejection heater resistor 100*a* and the supply heater resistor 100*b*. However, by having an asymmetric shape in the ink ejection direction B as described referring to FIGS. 13 and 14, the heater resistor itself may generate an anisotropic force of the bubble. Accordingly, the force for pushing the ink toward the ink orifice 7 and for supplying the ink into the ink channel 8 from the ink reservoir 9 toward the orifice 7 further increase.

Where the ejection heater resistor 100*a* and the supply heater resistor 100*b* are simultaneously supplied with the same electric pulse, the distance between the two heater resistors 100*a* and 100*b* may be selected to attain a desired ink ejection frequency.

The present inventor produced a printhead of parallel-type of a first concrete example of the present embodiment as shown in FIGS. 21 and 22. The ejection heater resistor 100*a* and the supply heater resistor 100*b* were formed on the glass substrate 1 in the ink channel 8 as shown in FIG. 21. Both heaters 100*a* and 100*b* were formed from a Cr—Si—SiO alloy thin-film resistor 3 and Ni thin-film conductors 4, 4' as shown in FIG. 2. At the end of the ink channel 8 near the ink reservoir 9, the ceiling 6, which was made of glass or some similar material, was slanted away from the supply heater resistor 100*b* as the ink channel progresses toward the ink reservoir 9. Thus, the asymmetric space portion 30 was formed where the supply heater resistor 100*b* was located. The ceiling 6 was sealingly combined with the glass substrate 1 into a printhead. The ejection heater resistor 100*a* was positioned near the ink ejection orifice 7. Both heater resistors 100*a* and 100*b* were formed in the ink channel 8 so as not to interfere with other ink channels. The ejection heater resistor 100*a* and the supply heater resistor 100*b* both had the same asymmetrical shape. The heater resistors 100*a* and 100*b* were serially connected to a power source (now shown) so that a pulse voltage may be simultaneously applied to both the heater resistors 100*a* and 100*b*. The resistance of the Cr—Si—SiO alloy provided in each heater resistor was set at 1.5 kΩ. Each ink channel was built to have a cross-section having an area of approximately 50 μm×60 μm. The printhead was formed with 48 drop generators so that 48 orifices (dots) may be arranged at a 125 μm pitch. The heating area 103 of the ejection heater resistor 100*a* was positioned in the ink channel 8 approximately 80 μm away from the ink ejection orifice 7. The heating area 103 of the supply heater resistor 100*b* was positioned in the ink channel 8 about 300 μm away from the heating area of the ejection heater resistor 100*a* and 150 μm away from the ink reservoir 9. The ink reservoir 9 and the ink channel 8 of the printhead were filled with ink. An image recording medium (not shown) was fed step by step in a position about 1.2 mm away from the ink ejection orifice 7. A pulse voltage having a voltage of 10 V and a pulsewidth of 10 μs was repeatedly applied at a frequency of 10 kHz to the heater resistors 100*a* and 100*b*. The ink ejected from the ink ejection orifices 7 formed clear ink images on the image recording medium, based on the on demand printing principle.

The present inventor increased the pulse frequency while maintaining all the other driving conditions of the heater resistors 100*a*, 100*b* mentioned above. Irregularities could be observed in the ejection of ink drops at frequencies of 13 to 15 kHz. It is presumed therefore that at these frequencies bubble expansion and bubble collapse periods should be overlapped. The present inventor then changed the driving conditions of the heater resistors. That is, the present inventor changed the voltage of a pulse voltage into 20 V and the pulsewidth into 2 μS, and applied the pulse voltage to the heater resistors. It was found that stable printing was obtained when the pulse voltage was applied to the heater resistors at a 15 to 18 KHz frequency. This high-speed ejection frequency is four times higher than possible in conventional thermal-pulse-type ink jet image recorders.

The present inventor removed the side of the printhead that forms one lateral wall of the 48th dot ink channel. The present inventor polished the exposed surface and attached a high-speed VCR and a high-speed camera to the surface for observing bubble generation and disappearance. It was observed that the drop generator was automatically refilled with ink, as shown in FIG. 23. Ink was smoothly supplied into the ink channel so that the meniscus smoothly recovered equilibrium. Adjacent ink channels were unaffected by this refilling process.

Figure 24:
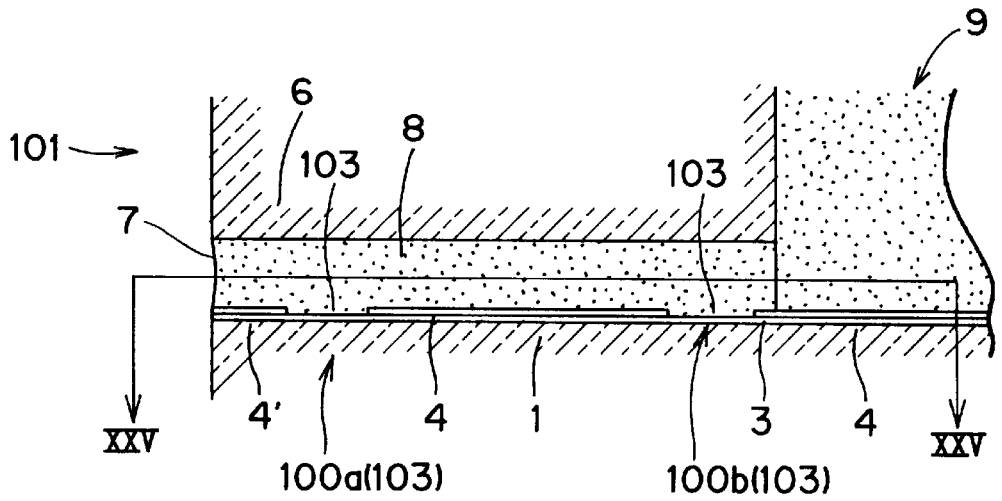
FIG. 24 shows a sectional side view of a parallel-type printhead according to another example of the third preferred embodiment.
Figure 25:
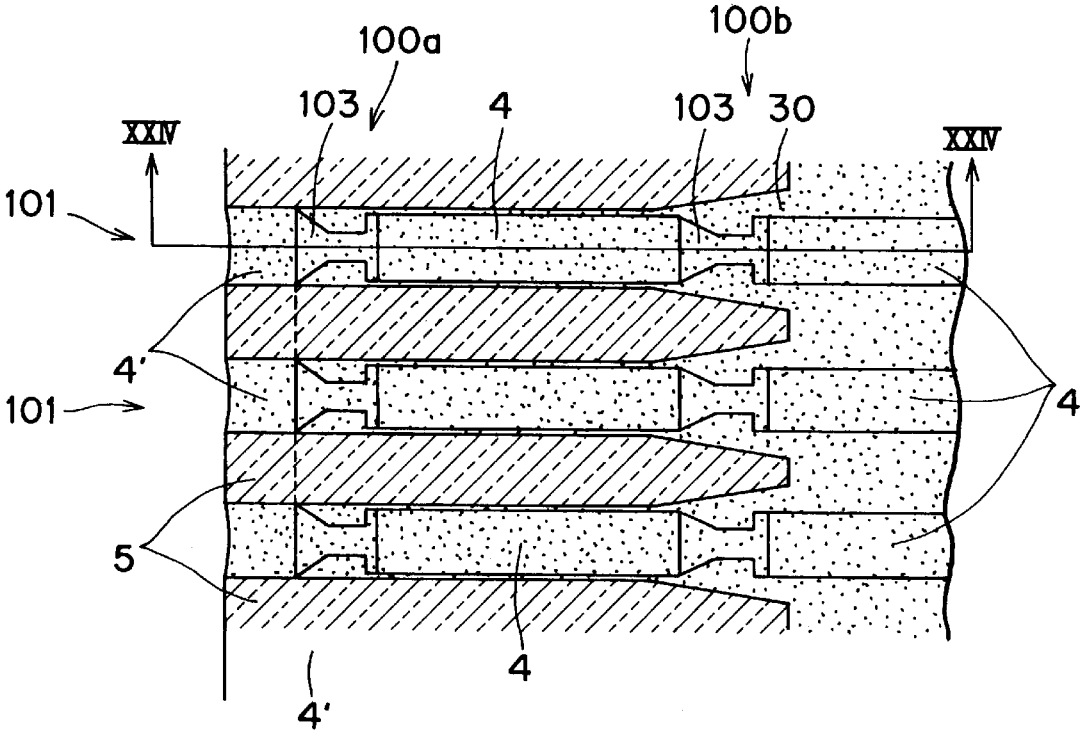
FIG. 25 shows a cross-sectional view of the printhead shown in FIG. 24 taken along a line XXV—XXV.

FIGS. 24 and 25 show another example of the present embodiment of a printhead of parallel-type. The printhead of this example has a structure almost the same as that of the printhead of FIGS. 21 and 22. (For example, the ejection heater resistor 100*a* and the supply heater resistor 100*b* are separated by a distance of about 300 μm, and the supply heater resistor 100*b* is positioned about 150 μm away from the ink reservoir 9.) The printhead of this example differs from the printhead of FIGS. 21 and 22, only in that the asymmetric space portion 30 of this example is formed by slanted surfaces of the lateral walls or barriers 5 which separate neighboring ink channels 8. Since the printhead of this example is not formed with the slanted ceiling 6 as formed in the printhead of FIGS. 21 and 22, in the process of producing the printhead of this example, the step of photoetching a glass substrate to form the slanted ceiling 6 can be eliminated. However, in order to form the lateral walls or barriers 5 with the slanted surfaces, the pitch of the ink channel array must be wide enough to accommodate forming the slanted surfaces on the walls 5. Accordingly, when a high density printhead is preferable, combining the structures of FIGS. 22 and 23 and of FIGS. 21 and 22 allows a narrow orifice pitch.

It is noted that the printhead of this example is operated in the same way as the example shown in FIGS. 21 and 22, and therefore explanation of operation thereof is omitted here.

Figure 26:
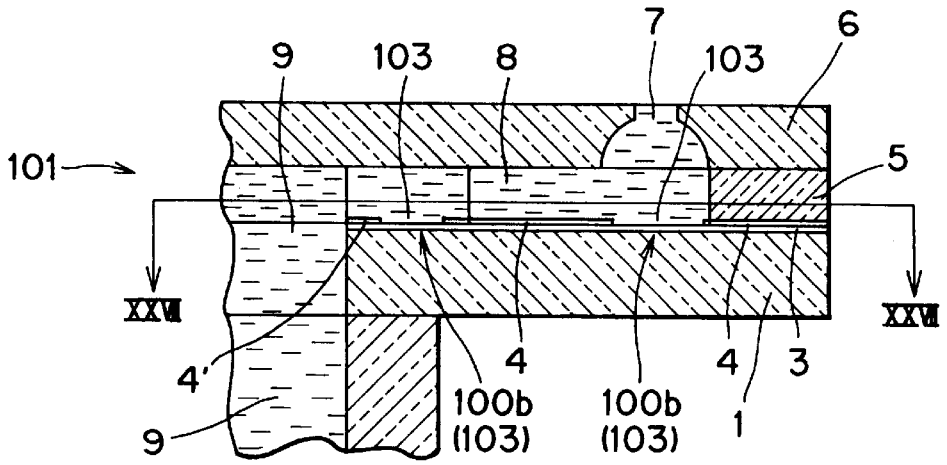
FIG. 26 shows a sectional side view of a parallel-type printhead according to a further example of the third preferred embodiment.
Figure 27:
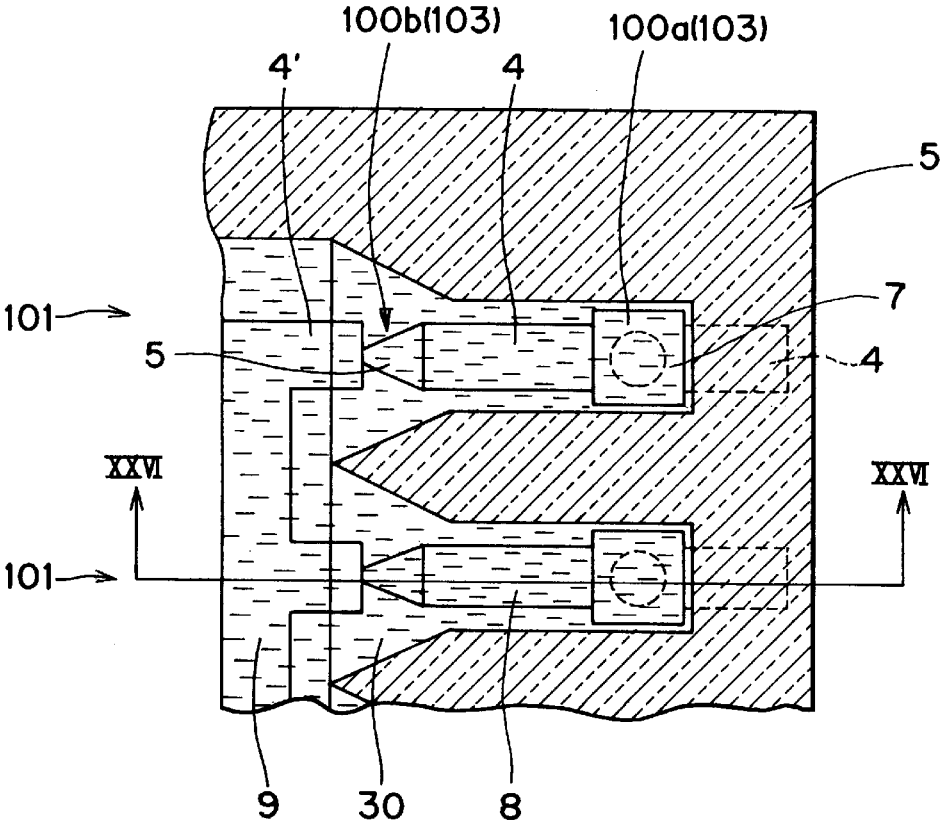
FIG. 27 shows a cross-sectional view of the printhead shown in FIG. 26 taken along a line XXVII—XXVII.

FIGS. 26 and 27 show an example of a printhead of perpendicular-type according to the present embodiment. The relative positional relationship of the two heater resistors 100*a* and 100*b* is the same as in the above-described examples for the parallel-type. It is noted that the ejection heater resistor 100*a* provided in the perpendicular-type printhead can more effectively exploit the expansion power of an expanding bubble produced thereby, as described already. The supply heater resistor 100*b* is provided in the ink channel 8 near the ink reservoir 9 where the ink channel 8 broadens as it progresses towards the ink reservoir 9 to thereby form the asymmetric space portion 30. The supply heater resistor 100*b* located in the asymmetric space portion 30 therefore speeds up the replenishment of ink. The principles and operations involved in this example are the same as those in the examples of FIGS. 21 through 25, and therefore will be omitted here.

It is noted that in the perpendicular-type, as shown in FIGS. 26 and 27, the heating area 103 of the supply heater resistor 100*b* is preferably shaped into an asymmetric shape as described referring to FIGS. 13 and 14 for further increasing the ink pushing force. However, the shape of the heating area 103 of the supply heater resistor 100*b* can be shaped into a symmetric shape as shown in FIG. 2A, similarly as that of the ejection heater resistor 100*a*. The heating area 103 of the ejection heater resistor 100*a*, on the other hand, should not be shaped into an asymmetric shape.

Figure 28:
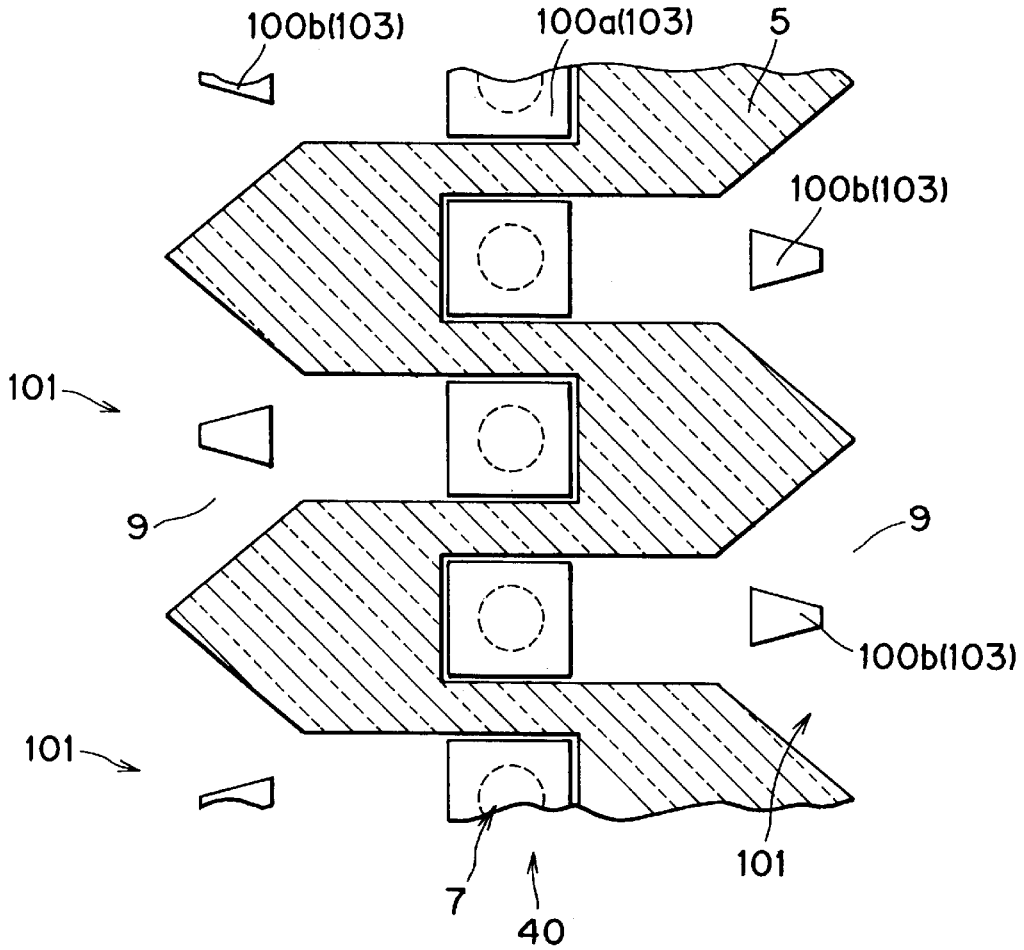
FIG. 28 shows a cross-sectional view of a modification of the printhead of FIGS. 26 and 27.

In order to attain a high orifice density without increasing cross talk between adjacent ink channels 8, the ink channels 8 may be arranged in a staggered manner as shown in FIG. 28 to form a row of orifices 40 where the orifices 7 are aligned. With this structure, the distance between orifices can be reduced without generating cross talk. The row of orifices 40 is a single in FIG. 28, but several rows 40 could be provided to the printhead.

Figure 29:
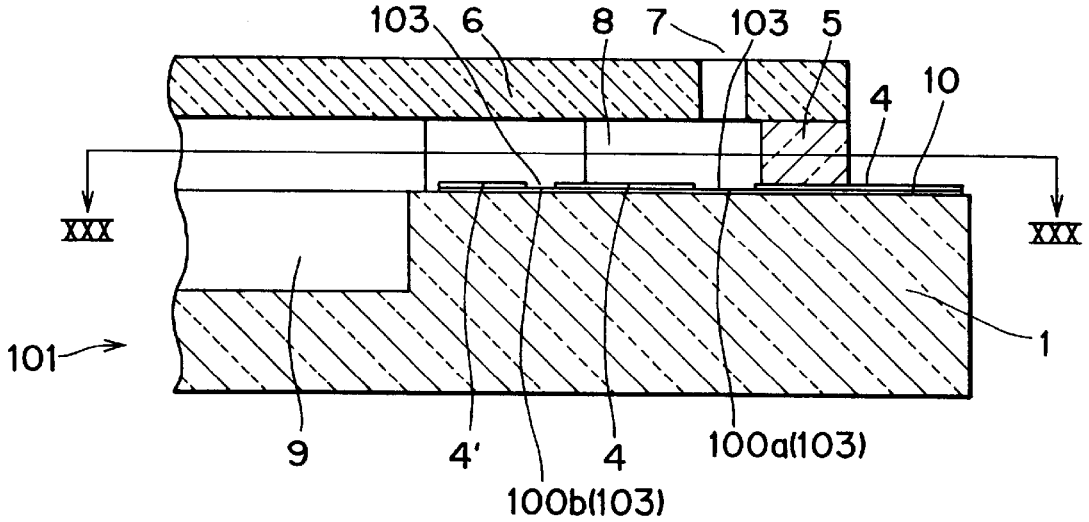
FIG. 29 shows a sectional side view of a perpendicular-type printhead according to a further example of the third preferred embodiment.
Figure 30:
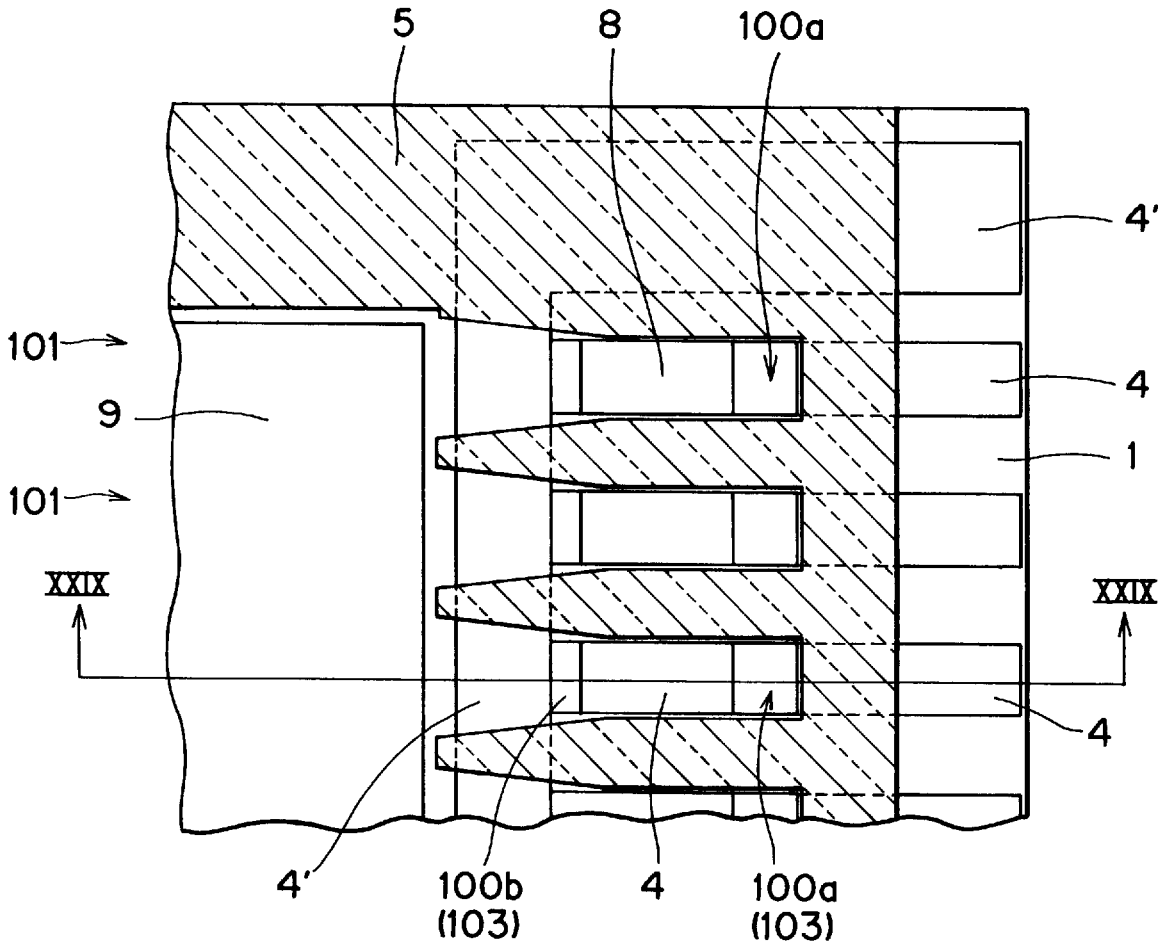
FIG. 30 shows a cross-sectional view of the printhead shown in FIG. 29 taken along a line XXX—XXX.

The printhead of this example shown in FIGS. 26 and 27 may be modified as shown in FIGS. 29 and 30. Although the ejection heater resistor 100*a* and the supply heater resistor 100*b* have the same resistance values in the above-described examples, in the present example, the supply heater resistor 100*b* is designed to have the resistance value of a half of that of the ejection heater resistor 100*b*. More specifically, as apparent from FIGS. 29 and 30, the length of the heating area 103 of the supply heater resistor 100*b* in the ink flowing direction is designed to have a value of a half of that of the heating area 103 of the ejection heater resistor 100*a*. With such a structure, energy applied to the supply heater resistor 100*b* becomes a half of that applied to the ejection heater resistor 100*a*, so that cross talk by the supply heater resistor 100*b* can be further restrained.

It is sufficient that the heater resistors 100*a* and 100*b* should be separated by a distance of 150 to 250 $\mu$m and the supply heater resistor 100*b* may be positioned 100 to 150 $\mu$m away from the ink reservoir 9. By tapering of the lateral walls or barriers 5 as the ink channel 8 progresses toward the ink reservoir 9, the ink channel 8 broadens to form the asymmetric space portion 30 near the ink reservoir 9. Such a structure enables high-speed refill of the drop generator, without generating cross talk.

The present inventor produced the printhead shown in FIGS. 29 and 30, and filled the ink reservoir 9 and the ink channel 8 with water-based ink. To evaluate ink ejection ability of this printhead, the present inventor applied an electric pulse having power per dot of 0.5 to 1 W/dot and a pulsewidth of 1 $\mu$s between the common electrode 4' and the individual electrode 4. The present inventor increased the application frequency of the electric pulse, and observed how the ink recording performance was changed. It was found that stable recording operation was achieved up to the frequency of 15 to 18 KHz. Although some instability was observed in the ink ejection direction when the heater resistors were driven at over 15 kHz, the fact that the printhead operated stably at ejection frequencies equal to or lower than 15 KHz would provide a great increase in recording speed over conventional thermal-pulse-type jet image recorders which are operated at ejection frequency of 3 to 4 KHz. Moreover, the printhead of this example required less power than conventional printheads. Temperature was easier to control. Thus, an image recorder using this printhead would have an image recording speed three to four times higher than that of conventional thermal-pulse-type ink jet image recorders and would also cost less to produce.

In the above description for the present embodiment, the ejection heater resistor 100*a* and the supply heater resistor 100*b* provided therein are formed from the protection layer-less heater resistors 100 of the first embodiment of the present invention. However, conventional heater resistor 200 with the protective layers may be applied to each of the ejection heater resistor 100*a* and the supply heater resistor 100*b*. In other words, the structure of the present embodiment, i.e., the combination of the ejection heater resistor and the supply heater resistor provided in the asymmetric space portion 30 can attain high printing speed whether the heater resistors are the protective-layer less heater resistors 100 or the conventional heater resistors 200 with the protective layers. According to the structure of the present embodiment, only a short period of time is required for the meniscus to recover its stable shape because the supply heater resistor 100*b* smoothly refills the ink channel 8 with ink to promote the recovering action of the meniscus. Therefore, the ejection frequency of the thermal-pulse-type ink jet printhead can be greatly increased. Compared to conventional thermal-pulse-type ink jet image recorders, the frequency of the printhead can be improved by two to four times.

Japanese Patent Applications Kokai No. SHO-61-49860 and Kokai No. SHO-62-167056 disclose Ta—Si—SiO alloy thin-film resistors. Ta—Si—SiO alloy thin-film resistors are as hard as Cr—Si—SiO alloy thin-film resistors. The present inventor has therefore deduced that Ta—Si—SiO alloy thin-film resistors should therefore be able to withstand cavitation just as well. To investigate this, the present inventor produced a heater resistor 100 having the structure shown in FIGS. 2 and 3 using Ni thin-film conductors 4, 4', but with a Ta—Si—SiO alloy thin-film resistor in place of the Cr—Si—SiO alloy thin-film resistor. The present inventor then performed SST on the heater resistor.

The experimental results were almost identical to those using a Cr—Si—SiO alloy thin-film resistor (see FIG. 9). One slight difference was that although with the Cr—Si—SiO alloy thin-film resistor the change in resistance became negative directly before the resistor blew, with the Ta—Si—SiO alloy thin-film resistor the change in resistance became increasingly positive before the resistor blew. However, this small difference did not affect the underwater life of the Ta—Si—SiO alloy thin-film resistor.

The present inventor further made printheads as depicted in the first through third embodiments, but including a heater resistor using a Ta—Si—SiO alloy thin-film resistor. Evaluation tests performed on these printheads provided results almost identical to those using a Cr—Si—SiO alloy thin-film resistor.

As described above, the protection layer-less heater resistor 100 provided according to the present invention has a simple structure having only two layers. This simple structure simplifies production processes by ⅓ thereby lowering production costs. Since the structure of the heater resistor becomes thus simplified, the pulse drive of the heater resistor can be shortened to 1 μs. By the time the bubble vanishes the heater resistor can therefore cool to near the ambient temperature, so that the ink ejection frequency can be greatly improved. This simplified structure further attains a 30 to 60 times increase in heat efficiency. This high heat efficiency not only reduces power consumption, but simplifies temperature regulation of the printhead and stabilizes ejection of ink.

The ink channel structure provided according to the present invention for achieving the ink pumping action allows further increase in the ink ejection frequency. The additionally provided supply heater resistor will further increase the ink ejection frequency.

Thus, the present invention can highly improve the printing speed of the ink jet image recording apparatus.

A fourth embodiment of the present invention will be described with reference to FIGS. 31 through 34.

The present inventors filled various water-based inks to the print heads employed with the protection layer-less heaters of the present invention. The present inventors then controlled the print heads to perform printing operations. Through these measurements, it was discovered that actual life of some heads was less than expected. After further investigation, it has been further discovered that the problem-free heads had been filled with ink having relatively high specific resistance and practically neutral pH. Problematic heads with life less than expected had been filled ink having low specific resistances of from $10^2$ to $10^3$ Ωcm and pH of 8 to 9.

The fourth embodiment is for overcoming this problem and for providing an improved print head and heaters with the same heating and bubble generating properties of the protection-layerless heater, but with long life even used with ink having low specific resistance and a non-neutral nature.

Figure 32A:
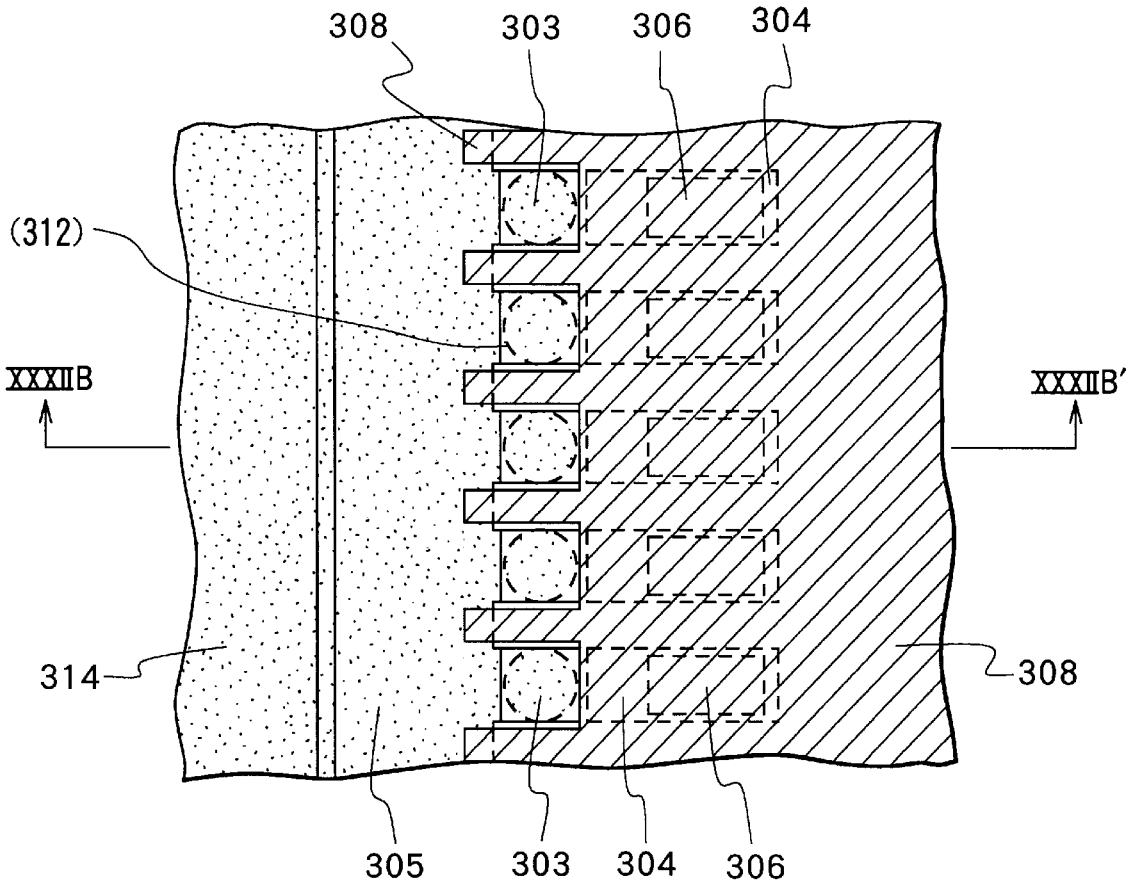
FIG. 32(*a*) is a cross-sectional view of the ink jet print head of the fourth embodiment taken along a line XXXI-IA–XXXIIA' of FIG. 32(*b*)
Figure 32B:
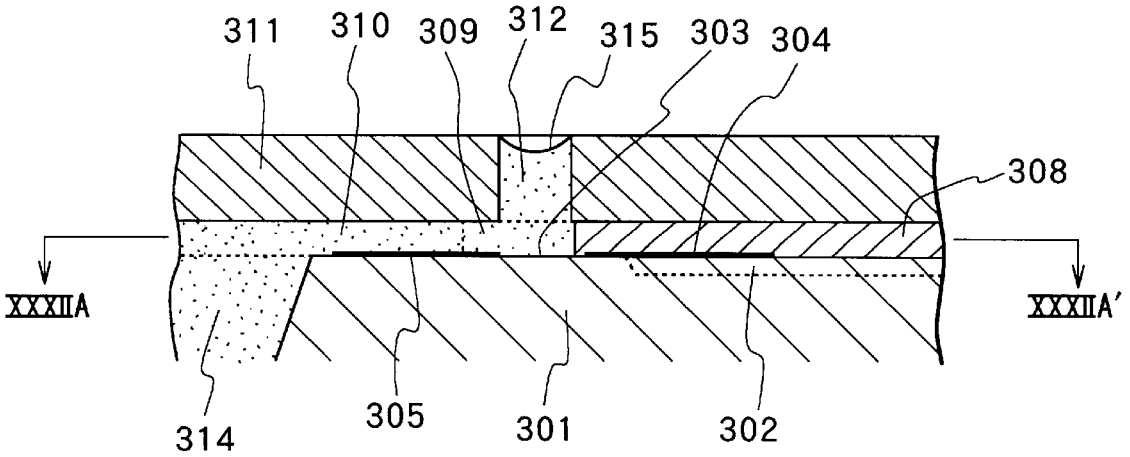

In an ink jet print head of the present embodiment, as shown in FIGS. 32(*a*) and 32(*b*), a partition wall 308 is provided over a silicon substrate 301 for forming a plurality of individual ink channels 309 and a common ink channel 310. A nozzle plate 311 is further provided over the partition wall 308. The nozzle plate 311 is formed with a plurality of ink ejection nozzles 312 juxtaposed along a line. The nozzles 312 are in fluid communication with corresponding individual ink channels 309. The common ink channel 310 connects the ink channels 309 to one another. A thin film resistor (which will be referred to as "heater" hereinafter) 303 is formed at the end of each ink channel 309 in confrontation with the nozzle 312. Two thin film conductors 304 and 305 are connected to each heater 303. The thin film conductor 305 serves as a common electrode for all the resistors 303. The thin film conductor 304 serves as an individual electrode for the corresponding resistor 303.

The partition wall 308, which forms the ink channels 310 and 309, covers all of the individual conductors 304 and further covers part of the heaters 303. The partition wall 308 has a thickness of less than 30 μm. In other words, the ink channel 309 is formed to a height of less than 30 μm. The nozzle plate 311 has a thickness of less than 80 μm. Accordingly, the nozzle 312 of a straight cylindrical shape has a depth of less than 80 μm. The heater 303 is formed into a square shape. The nozzle 312 and the heater 303 are shaped and aligned so that the inner perimeter of the nozzle 312 at the end thereof nearest the heater 303, when projected onto the heater, does not extend beyond the perimeter of the heater 303 by more than 5 μm.

In a representative example, each nozzle 312 has a 50 μm diameter. The ink channels 309 are formed to a height of 25 μm. Each heater 303 is formed into a square shape with width of 50 μm.

The partition wall 308 is preferably made from a heat-resistant resin such as polyimide which has a thermal breakdown starting point of 400° C. or more. The nozzle plate 311 may be made from the same material with the partition wall 308.

As shown in FIGS. 32(*a*) and 32(*b*), a drive LSI device 302 is formed on the silicon substrate 301. The drive LSI device 302 is constructed from a shift register circuit and a plurality of drive circuits. Each conductor 304 is connected to a corresponding drive circuit by passing through a through-hole 306. This configuration allows sequential drive of the resistors 303 by an external signal supplied to the device 302.

Figure 31:
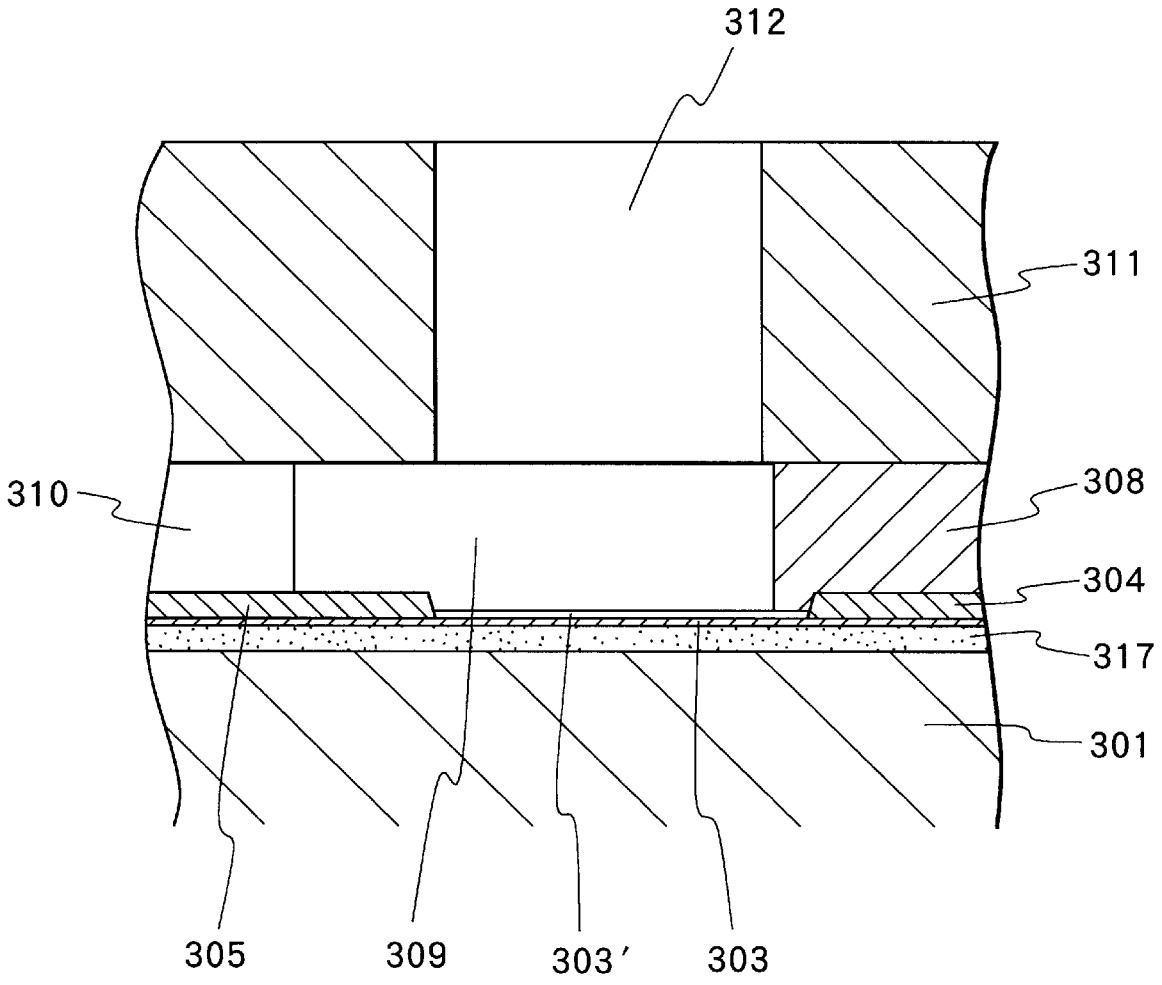
FIG. 31 is an enlarged sectional view of an ink jet print head of a fourth embodiment according to the present invention.

The heater 303 and the conductors 304 and 305 will be described below in greater detail with reference to FIG. 31. FIG. 31 is a sectional magnified view showing the area around one of the ink ejection nozzles 312 shown in FIGS. 32(*a*) and 32(*b*).

The heaters 303 and the conductors 304 and 305 are provided over an approximately 1 to 2 micrometer thick $SiO_2$ insulation layer 317 provided over the silicon substrate 301. This $SiO_2$ layer 317 is for insulating the silicon wafer 301 from heat generated by the heater 303. Each heater 303 is formed to an approximately 0.2 micrometers thickness from Ta—Si—SiO alloy, for example, which is very stable for pulsive operation up to the temperature of about 400° C. The conductors 304 and 305 are formed from 1 μm thick nickel (Ni) thin-film conductors.

The upper surface of the Ta—Si—SiO alloy thin-film resistor 303 is thermally oxidized into an oxidized layer 303'. This oxidized film 303' has an electrically-insulation property and has a good anti-galvanization property against electrolytic ink filled in the ink channel 309. The oxidized film 303' prevents the nonoxidized inner portion of the heater 303 from coming directly into contact with electrolytic ink filled in the ink channel 309. Accordingly, the life of each Ta—Si—SiO alloy thin-film resistor 303 will not be shortened by galvanization. Because the oxidized portion 303' is extremely thin, heat is transferred to the ink equally as well as with the case where the heater 303 is not provided with the oxidized portion 303'.

The oxidized film 303' will be described below in greater detail hereinafter.

Ta—Si—SiO alloy thin-film resistor has a certain thermal oxidation property. According to this thermal oxidation property, the resistance of the Ta—Si—SiO alloy thin-film resistor gradually increases when the resistor is placed in an air atmosphere under high temperature more than 500° C. More specifically, the Ta—Si—SiO alloy thin-film resistor is stable even when heated in an oxygen atmosphere at temperature of less then 400° C. However, when the temperature increases to reach the range of 450° C. and 500° C., the Ta—Si—SiO alloy thin-film resistor begins being oxidized at its surface. When the Ta—Si—SiO alloy thin-film resistor is heated in an oxidizing gas, such as air and oxygen, under 500° C. for ten minutes, the Ta—Si—SiO alloy thin-film resistor will be oxidized at its surface to a depth of in the range of 100 to 200 Å. In other words, the Ta—Si—SiO alloy thin-film resistor is formed with an electrically-insulating layer of a thickness in the range of 100 to 200 Å. The Ta—Si—SiO alloy thin-film resistor thus covered with the insulation layer will be stable unless the film is further heated under temperature of more than 500° C. When the Ta—Si—SiO alloy thin-film resistor covered with the insulation layer is employed in the print head, the resistor will be heated to a temperature in the range of 300° to 350° C. or less when applied with pulses to jet ink droplets. Accordingly, the film will stably perform the ink jet printing operation.

The present inventors performed the following measurements.

Figure 34:
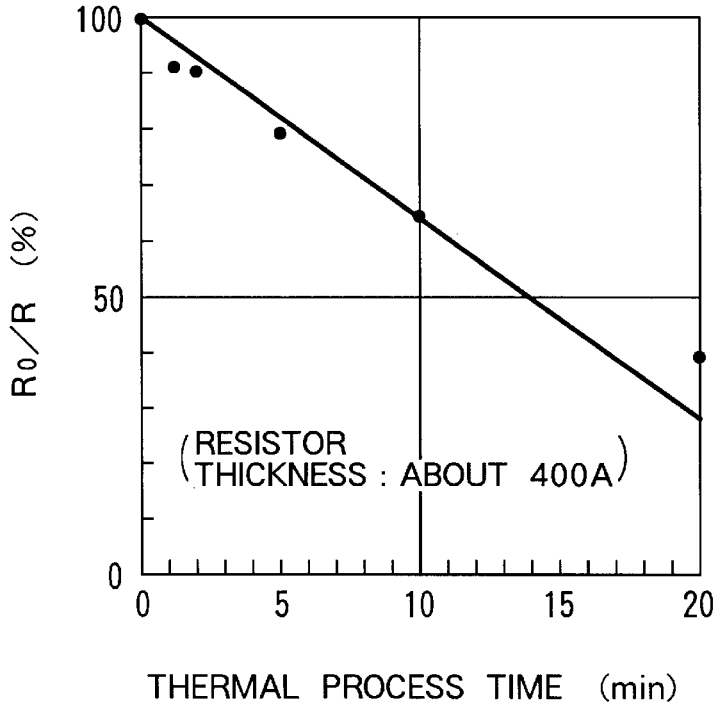
FIG. 34 is a graph showing how the resistance of a Ta—Si—SiO alloy thin-film resistor changes in the oxidizing atmosphere under temperature of 500° C.

The resistance of about 400 Å thick Ta—Si—SiO alloy thin-film resistors (referred to as resistor hereinafter) was measured while the resistors were placed in an air atmosphere at 500 degrees centigrade. FIG. 34 shows changes observed during these measurements in terms of Ro/R ratio, wherein Ro represents the original resistance of the resistor and R represents the resistance of the resistor after this thermal oxidation process. As can be seen in FIG. 34, the Ro/R ratio drops at a linear rate, which shows that the thermal oxidation processes oxidize the surface of the resistor at a speed, and to a depth from the surface, that is proportional to the thermal process time. It was further confirmed that entire surfaces of all the resistors were oxidized into electrically-insulating oxides by the thermal oxidation processes.

After the oxidation processes were finished, the resistors were placed in an air atmosphere of 350 degrees centigrade for a long time, and the resistance was again measured. It was confirmed that the resistance of the resistor remained unchanged in that air atmosphere of 350 degrees centigrade. The heaters were also supplied with a thermal pulse of 350 degrees centigrade one hundred million or more times in an air atmosphere. It was further confirmed that the resistance of the resistor remained unchanged even when thus further heated in thermal pulses.

The present inventor further conducted the following measurements.

A Ta—Si—SiO alloy resistor was subjected to the above-described thermal oxidation processes so that the resistor was covered with a thermally-oxidized insulation film of approximately 1,000 Å thickness. The resistor was then placed in an electrolyte ink with between 8 and 9 pH. The resistor was tested for susceptibility to galvanic corrosion by application of a potential gradient of 30 V/50 microns for 10 minutes or more. It was confirmed that no changes were observed in the resistor. This shows that even though the insulation film 303' was formed only to an extremely thin 1,000 Å thickness, the insulation film 303' was formed with no defects such as pinholes. The film 303' by nature can only be attained by the thermal oxidation processes and can be homogeneously formed.

Thus, the oxidized insulation film 303' can protect the non-oxidized portion of the heater 303 from galvanization by the electrolytic ink and lengthen the life of the heater 303. Additionally, because of this extreme small thickness, the film 303' can transfer heat to the ink with a high efficiency sufficiently to boil ink with fluctuation nucleation boiling similarly to the case where the resistor 303 is formed with no such films. According to the fluctuation nucleation boiling, a multiplicity of small bubbles with a uniform size are generated across the entire surface of the heater at a uniform distribution. The number of bubbles rapidly increases. The bubbles couple to form a bubble film at the surface of the heater. It is therefore possible to eject ink with a high ejection frequency. Details of the fluctuation nucleation boiling are described in page 334 of Collection of Presentations from the 27th Japan Thermal Transmission Symposium 1990–5.

As described above, as shown in FIGS. 32(*a*) and 32(*b*), the partition wall 308 covers all of the individual conductors 304 and further covers part of the heaters 303 connected to the conductors 304. The ink acts like an electrolyte with the same potential as the common conductor 305. The individual conductors 304 have a higher (or lower) potential than the ink. However, because the conductors 304 are separated by the ink with the partition wall 308, there is no possibility of the conductors 4 being effected by galvanization with the ink. On the other hand, the common conductor 305 does not need to be covered with the partition wall 308 because the conductor 305 and the ink are at the same potential so that the conductor 305 will not corrode. Though the heaters 303 are partly covered with the partition wall 308, the heaters 303 are covered with the partition wall 308 only about 5 to 8 microns beyond the tip of corresponding electrodes 304. This will reduce thermal efficiency of the heaters 303 by only 10 to 15%. Thus, the above-described arrangement allows construction of a head that is highly reliable in regards to electrolytic ink, while maintaining the high thermal efficiency of the heaters 303.

The partition wall 308 is made from a heat-resistant resin such as polyimide which has a thermal breakdown starting point of 400° C. or more. In order to perform the fluctuation nucleation boiling to provide a high frequently ejection operation, the heaters 303 have to be heated to about 310° C. Considering the variations in the heaters 303 and in the driving circuit, the heaters 303 can be controlled in the range of 310° C. and 370° C. The temperature at a part of the partition wall 308 nearest the resistor 303 will therefore reach between 360° C. and 370° C. even at maximum. During the life of the head, the resistor 303 will be energized by pulses of pulse width of about 0.2 μs at the maximum temperature about a hundred million times. Accordingly, the maximum temperature will last only for 20 seconds (=0.2 μs× a hundred million) in total during the life of the print head. Accordingly, problems relating to the life of the partition wall 308 will not occur as long as the partition wall 308 is formed from a heat resistant resin, such as polyimide, which starts breaking down at temperatures of 400 degrees centigrade or more.

In contrast to this, it has been confirmed that a conventional partition wall, made from a photosensitive resist or other material with low heat tolerance, will be ruptured by galvanic corrosion after about ten million ejections. By forming the partition wall 308 from a heat resistant resin, the head will be reliable even if the partition wall 308 is positioned imprecisely to partly overlap the heaters 303 in the widthwise direction of the individual ink channels 309. This provides some leeway in alignment precision when aligning components during assembly of the head.

According to the present embodiment, the ink supply channel 309 is formed to a height of less than 30 μm. The nozzle 312 has a straight cylindrical shape. The nozzle 312 and the heater 303 are aligned so that the inner perimeter of the nozzle 312 at the end thereof nearest the heater 303, when projected onto the heater, does not extend beyond the perimeter of the heater 303 by more than 5 μm. The height or depth of the nozzle 312 is less than 80 μm. According to these sizes, a bubble generated on the heater 303 can grow to reach the uppermost aperture position of the nozzle 312 and connect with the outer atmosphere. This will prevent the bubble from being collapsed.

This phenomenon will be described below in greater detail.

When the heater 303 is driven to generate bubbles by fluctuation nucleation boiling, the bubble expands upward without growing more than 5 to 10 μm beyond the edges of the heater 303 and the height of the bubble is about 30 μm at the maximum stage of growth. It can therefore be understood that if the height of the ink channel 309 is more than 30 μm or if the perimeter of the heater 303 and the inner perimeter of the nozzle 312 at the end thereof nearest the heater 303 are out of 5 μm alignment, the portion of the liquid, located above the bubble to be ejected, and the liquid remaining in the ink channel 309 be connected. This will prevent the bubble from growing to the uppermost aperture position of the nozzle 312.

The following measurements were performed to confirm this phenomenon.

Figure 33A:
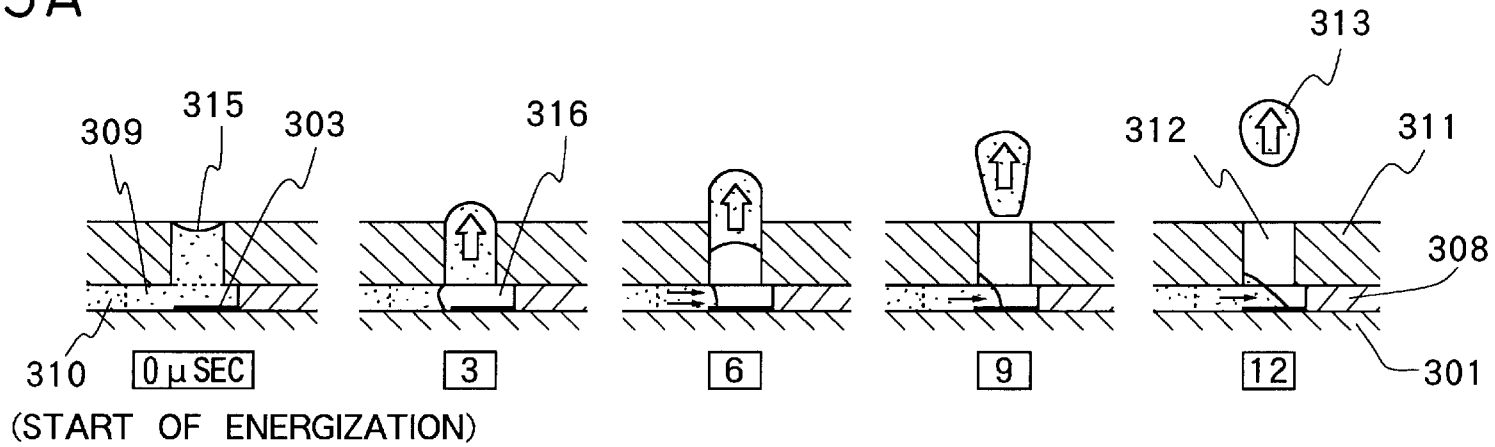
FIG. 33(*a*) illustrates observation results showing how bubbles and ink droplets move in the nozzle of the present embodiment.
Figure 33B:
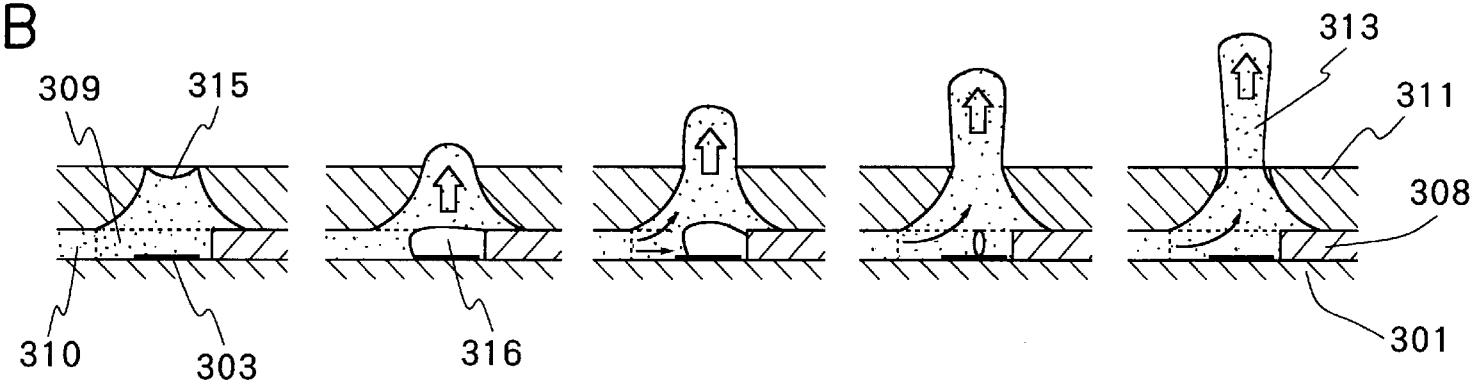

The present inventors fabricated a print head of the present embodiment, in which the ink ejection nozzles 312 had a straight cylindrical shape shown in FIG. 33(*a*). More specifically, the heaters 303 were formed with an area of 50×50 $\mu m^2$. The partition wall 308 was formed from polyimide to a height of 25 microns so as to provide the 25 microns high ink channel 309. The orifice plate 311 was formed by adhering and hardening a polyimide film, with a thickness of about 50 microns, to the surface of the partition wall 308. Ink ejection apertures or nozzles 312 were formed in the polyimide film 311 to a diameter of 50 microns directly above the thin-film heaters 303 using the photo dry etching techniques.

The present inventors also fabricated a comparative print head. As shown in FIG. 33(*b*), the comparative print head was similar to that shown in FIG. 33(*a*) with the exception that the ink ejection nozzle 312 opened in the orifice plate 311 to flare out at the end facing the heater 303.

Because polyimide is virtually transparent, generation of bubbles and ejection of droplets that occur when the resistors 303 are energized can be observed by filling the channels with water and energizing the heaters while photographing using stroboscopic photography. The observation results during and after energizing the heaters with a 2 microsecond long pulse are shown in FIGS. 33(*a*) and 33(*b*).

In the print head of the present embodiment, as shown in FIG. 33(*a*), between 2 and 3 microseconds after start of energization, a bubble with internal pressure of almost zero has been generated and the water in the nozzle 312 has just started moving at a speed of between 12 and 15 m/s. However, the water in the ink channel 309 has not yet started moving. After 6 microseconds elapses after start of energization, the tail end of the water body which will become the ejected droplet has approached near the uppermost aperture position of the nozzle 312. On the other hand, a one-atmosphere pressure difference, between the outer atmosphere and the bubble in the nozzle, has started pulling the water in the ink channel 309 toward the heater 303. After 9 microseconds after start of energization, the pressure within the nozzle 312 has reached to atmospheric pressure, thereby reducing the pressure difference to zero so that movement of water in the ink channel 309 becomes sluggish. Thereafter, approximately 70 microseconds is required to refill the water in the nozzle 312. As was apparent from these observations, the portion of the liquid, located above the bubble to be ejected, was not connected to the liquid remaining in the ink channel 309. The bubble grew to reach the uppermost aperture position of the nozzle 312 and connected with the outer atmosphere. Accordingly, the phenomenon of vacuum bubble collapse did not occur. The associated shock waves, which are a source of cavitation, also did not occur.

In contrast to this, when the nozzle base was greatly flared out as shown in FIG. 33(*b*), the water mass to be ejected was completely connected with the water in the ink channel 309, which results in generation of a shock wave when the vacuum bubble vanishes about 9 microseconds after start of energization. This shock wave was not as strong as generating the phenomenon of rebound, which will generate secondary bubbles. However, this shock wave applies a partial shock to the central portion of the heater 303, which can destroy the heater 303, as described on page 41 of the February 1994 edition of the Hewlett-Packard Journal.

The present inventors further attained experiments to determine the life of the above-described heads of FIGS. 33(*a*) and 33(*b*) when filled with an electrolytic ink. In the experiments, the present inventors filled the electrolytic ink to a plurality of heads of each type of FIGS. 33(*a*) and 33(*b*) and applied a great number of pulses to the heads.

The experimental results show that the head having the nozzle configuration of FIG. 33(*a*) was able to withstand one hundred million pulses or more for ejecting the electrolytic ink. This is clearly superior to the configuration shown in FIG. 33(*b*), which could only withstand from one million pulses or less to about ten million pulses. The life of the heads of FIG. 33(*b*) is thus widely distributed from one million pulses or less to about ten million pulses.

The present inventors directly detected the presence or absence of the above-described shock using an AL sensor (acoustic emission sensor) affixed to the underside of the head substrate. It was confirmed that the shock conventionally observed at time of bubble collapse was not detected at all, which shows that bubble collapse was eliminated. Even the shock detected with the bubble generation in the head of the present embodiment was one tenth or less of the shock detected during generation and collapse of the bubble in an open pool operation.

The present inventors further confirmed that when the orifice plate 11 was formed to a thickness of 80 microns or more, ink sometimes completely refilled the area above the heater 303 before the ink to be ejected separated from the nozzle 312. This generated shock waves and also associated cavitation that shortened the life of the heater.

Thus, according to the present embodiment, the ink supply channel 309 is formed to a height of less than the maximum height of the bubble, that is less than 30 μm. The nozzle 312 and the heater 303 are shaped and aligned so that the inner perimeter of the nozzle 312 at the end thereof nearest the heater 303, when projected onto the heater, does not extend beyond the perimeter of the heater 303 by more than 5 μm. With this arrangement, a bubble formed on the heater 303 can grow to the uppermost end of the nozzle 312 and can connect with the outer atmosphere. The bubble will not collapse and will not generate any shock wave. Because the depth of the nozzle 312 is less than 80 μm, ink will not be completely refilled the area above the heater 303 before the ink to be ejected is separated from the nozzle 312. Shock waves will not be generated.

A method of producing the above-structured print head of the present embodiment will be described below.

Using a slight modification of a standard bipolar LSI fabrication process, the drive LSI device 302 is formed on a surface of the silicon substrate 301. The $SiO_2$ film 317 is formed to the surface of the silicon substrate 301 during this LSI fabrication processes.

An approximately 0.2 micron thick Ta—Si—SiO alloy thin-film resistor and an approximately 1 micron thick nickel thin film are formed over the $SiO_2$ film 317 using sputter techniques. More specifically, the alloy thin-film resistor is formed using reactive sputter techniques in an argon atmosphere containing oxygen. The nickel thin film is formed using high-speed sputter techniques in a high magnetic field. Then, the thin-film heaters 303, the individual conductors 304, and the common thin-film conductor 305 are formed using photoetching techniques.

Thus fabricated head is located in an oven filled with air or oxygen gas, and the heaters 303 are subjected to thermal oxidation processes so that the insulation films 303' are formed to the surface of the heaters 303 in the following manner.

The above-described monolithic LSI head can not be entirely subjected to the thermal oxidation processes at 400 degrees centigrade or greater. The thermal oxidation processes will possibly oxidize also the nickel thin film conductors 304 and 305. Therefore, in this example, thermal oxidization processes are performed by energizing the alloy thin film resistor 303 in pulses so that only the resistor 303 itself is pulsingly heated to about 550 to 600 degrees centigrade.

The most effective method of performing the thermal oxidization processes is to energize the resistor 303 in long pulses so that a high temperature is maintained at the resistor 303 for about one millisecond. This can easily be performed by pulsingly driving the resistors 303 using an external control device. That is, thermal oxidation processes are performed using a pulse width of about 1 ms that is about $10^3$ longer than the pulse length (1 to 2 $\mu$s) used for actually driving the resistors. Even heating the resistors 303 during thermal oxidation processes to a temperature that is about 200 to 250 degrees centigrade hotter than the temperature used to actually drive the resistors 303 will require much less than the rated power of the drive LSI and so can be performed without any problem. During these pulse heating processes, the oven can be used to heat the silicon base 301 to a temperature of about 100 degrees centigrade.

These thermal oxidation processes increase the resistance of the thin-film resistor 303 by from 30 to 40%. According to the present embodiment, the resistance of the thin-film resistors 303 is simultaneously measured and detected during the thermal oxidation processes so that all the resistors 303 mounted to the head will have a uniform resistance. More specifically, in the thermal oxidation process, the resistance values of all the thin-film resistors are monitored while the thin-film resistors are pulsingly energized. Based on the monitored results, the pulses applied to the respective thin-film resistors are adjusted so that the resistance values of all the thin-film resistors will be substantially uniform. For example, the number of times at which the pulses are applied to the respective resistors may be adjusted.

The present inventors conducted the following experiments. While applying pulses to the resistors 303, the resistance values of the resistors 303 were monitored. The pulses were adjusted according to the monitored results. As a result, resistance values of all the resistors were adjusted to within ±1%. This contrasts with the ±5% variation that can be found in resistance values of a row of resistors provided to the conventional print heads. Having the uniform resistance, all the resistors will heat the ink to a uniform temperature when actually driven then unnecessary heating will be eliminated. Therefore, the reliability of the head will be improved. Ink will not be scalded and the life of the resistors will be increased.

After the insulation films 303' are thus formed to the surfaces of the heaters 303, polyimide is provided on the surface of the silicon substrate 301, and a partition wall 308 is formed through etching the polyimide to define the individual ink channels 309 and the common ink channel 310. Then, a polyimide film 311 is provided over the surface of the partition wall 308, and ink ejection apertures 312 are formed in the polyimide film 311 directly above the thin-film heaters 303.

Figure 35:
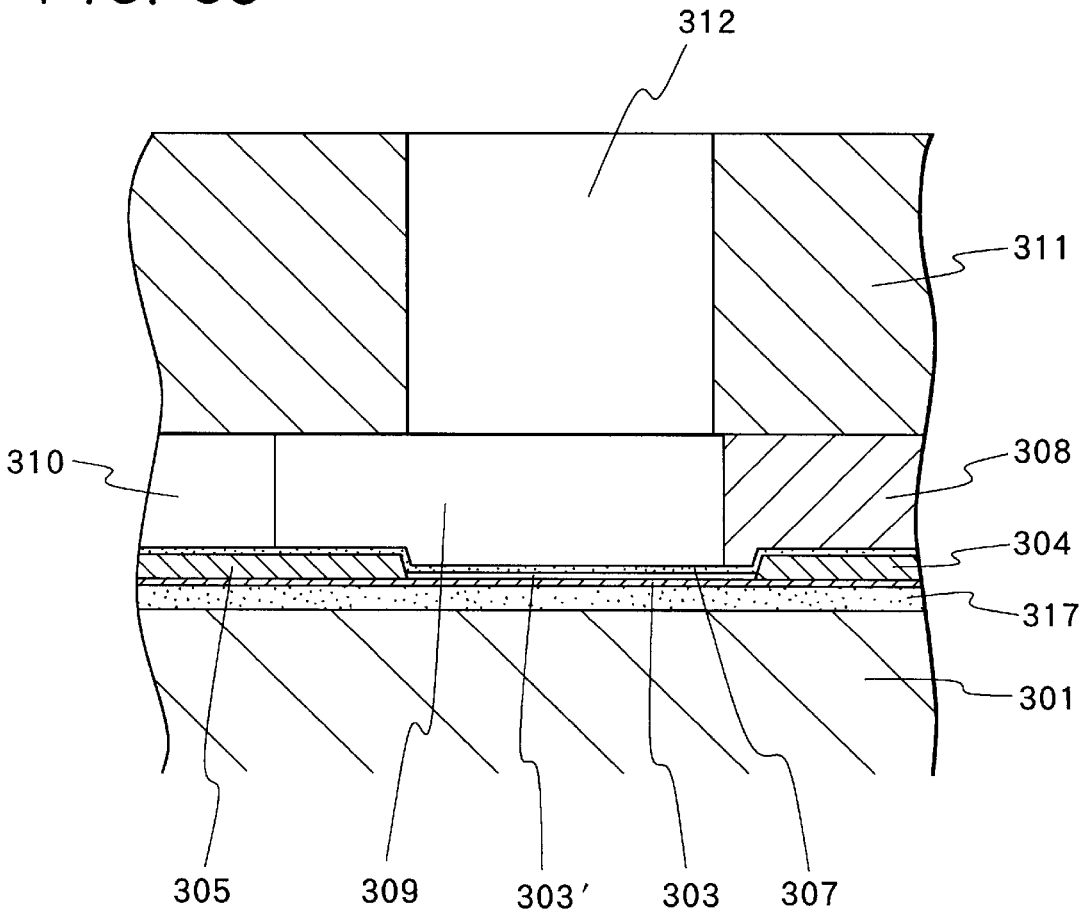
FIG. 35 is an enlarged sectional view of an ink jet print head according to a fifth embodiment.

A fifth embodiment of the present invention will be described below in greater detail with reference to FIG. 35.

This embodiment is especially effective when the resistors 303 are not formed from Ta—Si—SiO alloy, but are formed from material wherein an insulation oxidation film 303' can be formed through subjecting the material to the thermal oxidation processes but the formed insulation oxidation film 303' is easily defected with pin holes. According to this embodiment, an additional insulation layer 307 is provided over both the heaters 303 and the conductors 304 and 305 for protecting the insulation film 303'. The thickness of the layer 307 is substantially equal to the thickness of the thin-film resistors 303. The layer 307 is therefore sufficiently thin to provide thermal efficiency as high as the case where the layer 307 is not provided.

The insulation layer 307 can be formed from any insulating material with good scaling and covering characteristics. For example, the insulation layer 307 can be formed from a $SiO_2$ layer, a $Ta_2O_5$ layer, or a $Si_3N_4$ using RF sputter techniques, a $Si_3N_4$ layer using plasma CVD techniques, a $Al_2O_3$ using Zorger coat techniques, or an SOG film using commonly used semiconductor processes. The present inventors confirmed that it is effective to cover the entire surface of the heater 303 with the insulation layer 307.

Because of the small thickness of the layer 307, energization power required to induce fluctuation nucleation boiling is still small. For example, when energization power is applied in pulses of 2 microseconds, the energization power required to induce the fluctuation nucleation boiling need be only about 1.5 the power required for a naked, or protection layerless, heater. This is still one seventh to one tenth the amount of energy that must be applied for driving conventional heaters with a thick two-layer construction. It can be seen that the heater according to the present invention has excellent heat efficiency. This excellent heat efficiency allows forming the drive circuit and the heaters integrally on the same silicon substrate at a high density. This allows manufacturing a high-speed full-color ink jet printer with this high-density head.

As described above, according to the fourth and fifth embodiments of the present invention, the extremely thin thermal oxidization layer 303' (and an additional thin insulation layer 307 formed thereon) separate the resistor 303 from the electrolytic ink. The heat-resistant walls 308 separate all the individual electrodes entirely from the electrolytic ink. The nozzles 312 are formed in a shape that prevents bubbles generated by nucleate boiling from vanishing so that the thin insulation layer 303' is protected from destruction by cavitation. The thin insulation layer 303' allows almost complete prevention of damage to the heater 303 by galvanic corrosion without reducing the heat efficiency of the heater 303. This allows manufacture of a highly reliable high-density head and a high-speed full-color ink jet printer capable of printing with an electrolytic ink.

A long line head can be produced by connecting ends of two print heads of the above-described embodiments along a nozzle aligned direction. In this case, the nozzles of each print head can be slanted toward the connecting ends. Also in this case, the nozzles and the heaters should be positioned so that the inner perimeter of each nozzle at the end thereof nearest the corresponding heater, when projected onto the heater, does not extend beyond the perimeter of the heater by more than 5 $\mu$m.

As described above, according to the fourth and fifth embodiments, a plurality of heaters are provided on a silicon substrate in a plurality of individual ink channels. Each heater is constructed from a thin-film resistor and a thin-film conductor. The thin-film resistor is formed with an electrically-insulation layer at its upper surface. The electrically-insulation layer is formed through subjecting the thin-film resistor to a high-temperature thermal oxidation process. The thin-film resistor formed with the electrically-insulation layer may be covered with an additional insulation layer of a thickness substantially equal to the thin-film resistor.

While the invention has been described in detail with reference to specific embodiments thereof, it would be apparent to those skilled in the art that various changes and modifications may be made therein without departing from the spirit of the invention.

For example, the ink reservoir 9 may be detachably mounted in the printhead.

Although not shown in the drawings, in an ink ejection printer, an image recording medium may be supported at a position confronting the plurality of nozzles of the print head of the present invention. A relative motion is attained between the print head and the image recording medium in a direction orthogonal to a direction along which the plurality of nozzles are aligned.

The structures of the fourth and fifth embodiments may be combined with the structures proposed in the first through third embodiments.

What is claimed is:

1. An ink ejection print head for ejecting ink droplets to print an image, the print head comprising:

a silicon substrate;

a partition wall provided on the silicon substrate for defining a plurality of individual ink channels;

a plurality of heaters provided in the individual ink channels, each heater comprising a Ta—Si—SiO alloy thin-film resistor and a thin-film conductor formed on the silicon substrate, a surface of each thin-film resistor having an electrical insulation layer which is formed by high-temperature thermal oxidation of the thin-film resistor and which is in direct contact with the ink in the print head; and an ejection nozzle comprising a plurality of nozzles at positions corresponding to the plurality of heaters.

2. An ink ejection print head as claimed in claim 1, wherein each of the plurality of nozzles extends in a direction substantially perpendicular to an upper surface of a corresponding heater.

3. An ink ejection print head as claimed in claim 2, wherein the partition wall forms the individual ink channels to a height of less than 30 $\mu$m.

4. An ink ejection print head as claimed in claim 3, wherein each heater and a corresponding nozzle are formed such that an inner perimeter of the nozzle when projected on the heater as aligned with the heater is within 5 $\mu$m of an edge of the heater.

5. An ink ejection print head as claimed in claim 1, wherein each of the plurality of nozzles extends in a direction substantially perpendicular to an upper surface of a corresponding heater, the partition wall forming the individual ink channels to a height of less than 30 $\mu$m, each heater and a corresponding nozzle being formed such that an inner perimeter of the nozzle when projected on the heater as aligned with the heater is within 5 $\mu$m of an edge of the heater, the ejection nozzle portion having a thickness of less than 80 microns such that the depth of the ejection nozzle is less than 80 microns.

6. An ink ejection print head as claimed in claim 5, wherein the plurality of thin-film conductors include a common electrode connected to all of the plurality of heaters and a plurality of individual electrodes connected to the corresponding heaters, wherein the partition wall comprises a heat-resistant resin provided on the substrate, the partition wall covering entire portions of all the individual electrodes to define the individual ink channels.

7. An ink ejection print head as claimed in claim 6, wherein the partition wall further covers portions of the thin-film resistors.

8. An ink ejection print head as claimed in claim 1, wherein the plurality of thin-film conductors include a common electrode connected to all of the plurality of heaters, and a plurality of individual electrodes connected to the corresponding heaters, wherein the partition wall comprises a heat-resistant resin provided on the substrate, the partition wall covering portions of all the individual electrodes to define the individual ink channels.

9. An ink ejection print head as claimed in claim 8, wherein the partition wall further covers portions of the thin-film resistors.

10. An ink ejection print head as claimed in claim 8, wherein the heat-resistant resin for forming the partition wall has a thermal breakdown starting temperature of 400 degrees centigrade or more.

11. An ink ejection print head as claimed in claim 1, wherein the partition wall further defines a common ink channel provided on the silicon substrate in fluid connection with all the individual ink channels.

12. An ink ejection print head as claimed in claim 1, wherein the ejection nozzle portion has a thickness of less than 80 microns such that the depth of the ejection nozzle is less than 80 microns.

13. An ink ejection print head as claimed in claim 1, wherein each of the thin-film conductors comprises a nickel metal thin-film conductor.

14. An ink ejection print head as claimed in claim 1, further comprising an additional insulation layer covering said thin-film resistors and the thin-film conductors, said additional insulation layer having a thickness substantially equal to a thickness of said thin-film resistors.

15. An ink ejection printer for printing an image with ejected ink, the printer comprising:

a print head including a silicon substrate, a partition wall provided on the silicon substrate for defining a plurality of individual ink channels, a plurality of heaters provided in the individual ink channels, each heater being made from a Ta—Si—SiO alloy thin-film resistor and a thin-film conductor formed on the silicon substrate, a surface of each thin-film resistor having an electrical insulation layer which is formed by high-temperature thermal oxidation of the thin-film resistor and which is in direct contact with the ink in the print head, and an ejection nozzle portion formed with a plurality of nozzles at positions corresponding to the plurality of heaters;

support means for supporting an image recording medium at a position confronting the plurality of nozzles of the print head; and motion means for attaining a relative motion between the print head and the support means in a direction orthogonal to a direction along which the plurality of nozzles are aligned.

16. An ink ejection printer as claimed in claim 15, wherein each of the plurality of nozzles extends in a direction substantially perpendicular to an upper surface of a corresponding heater, the partition wall forming the individual ink channels to a height of less than 30 $\mu$m, each heater and a corresponding nozzle being formed such that an inner perimeter of the nozzle when projected on the heater as aligned with the heater is within 5 $\mu$m of the edge of the heater, the ejection nozzle portion having a thickness of less than 80 microns such that the depth of the ejection nozzle is less than 80 microns.

* * * * *

UNITED STATES PATENT AND TRADEMARK OFFICE

CERTIFICATE OF CORRRECTION

PATENT NO. : 5,831,648
DATED : Nov. 3, 1998
INVENTOR(S) : Mitani et al It is certified that error appears in the above-identified patent and that said Letters Patent is hereby corrected as shown below:

On the title page: Item [56]

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | DE | 3 | 4 | 0 | 26 | 83 | A1 | 01-26-84 | Germany | | | | |
| | | | | | | | | | | | | | | |

Signed and Sealed this

Second Day of March, 1999

*Attest:*

Q. TODD DICKINSON

*Attesting Officer*

*Acting Commissioner of Patents and Trademarks*